US008483598B2

(12) United States Patent
Enoki et al.

(10) Patent No.: US 8,483,598 B2
(45) Date of Patent: Jul. 9, 2013

(54) ELECTROPHOTOGRAPHIC IMAGE FORMING METHOD AND APPARATUS WITH A COVER FILM SUPPLYING DEVICE

(75) Inventors: Shigekazu Enoki, Kawasaki (JP); Takuya Suganuma, Yamato (JP); Ryuji Yoshida, Yokohama (JP); Yoshinori Nakagawa, Yokohama (JP); Atsushi Kurokawa, Atsugi (JP); Ichiro Kadota, Kawasaki (JP); Naoyuki Ozaki, Zama (JP); Hiroki Atari, Yokohama (JP); Hiroyuki Sugiyama, Yokohama (JP); Kazuhisa Sudo, Kawasaki (JP); Masanori Kawasumi, Yokohama (JP); Hiroshi Nakai, Yokohama (JP); Shin Kayahara, Kamakura (JP); Shuji Tanaka, Chigasaki (JP)

(73) Assignee: Ricoh Company, Limited, Tokyo (JP)

( * ) Notice: Subject to any disclaimer, the term of this patent is extended or adjusted under 35 U.S.C. 154(b) by 470 days.

(21) Appl. No.: 12/758,287

(22) Filed: Apr. 12, 2010

(65) Prior Publication Data

US 2010/0278558 A1 Nov. 4, 2010

(30) Foreign Application Priority Data

Apr. 30, 2009 (JP) ..... 2009-111208

(51) Int. Cl.
*G03G 15/00* (2006.01)

(52) U.S. Cl.
USPC ..... 399/161

(58) Field of Classification Search
USPC ..... 399/161, 130, 342, 341, 378
See application file for complete search history.

(56) References Cited

U.S. PATENT DOCUMENTS

| | | | | |
|---|---|---|---|---|
| 5,065,183 | A * | 11/1991 | Morofuji et al. | 399/299 |
| 5,918,091 | A | 6/1999 | Saeki | |
| 2008/0102399 | A1 | 5/2008 | Nakamura et al. | |

FOREIGN PATENT DOCUMENTS

| | | |
|---|---|---|
| JP | 59-143181 | 8/1984 |
| JP | 62-113188 | 5/1987 |
| JP | 02-015282 | 1/1990 |
| JP | 02-166472 | 6/1990 |
| JP | 02-197884 | 8/1990 |
| JP | 03-077986 | 4/1991 |
| JP | 3-65146 | 6/1991 |
| JP | 4-344679 | 12/1992 |

(Continued)

OTHER PUBLICATIONS

Office Action issued Apr. 12, 2013, in Japanese Patent Application No. 2009-111208.

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

The image forming apparatus includes a latent image bearing member; a charging device charging the surface of the latent image bearing member; a latent image forming device forming an electrostatic latent image on the surface of the latent image bearing member; a developing device supplying toner to the electrostatic latent image to form a toner image; a cover film supplying device supplying a cover film to the surface of the latent image bearing member at a cover film supplying position located on an upstream side from the development position so that the toner image is formed on the cover film covering the surface of the latent image bearing member; and a cover film separating device separating the cover film bearing the toner image thereon from the surface of the image bearing member before the cover film bearing the toner image thereon reaches the cover film supplying position.

17 Claims, 18 Drawing Sheets

FOREIGN PATENT DOCUMENTS

| | | | |
|---|---|---|---|
| JP | 05-297702 | | 11/1993 |
| JP | 06246960 | A * | 9/1994 |
| JP | 10-301445 | | 11/1998 |
| JP | 2008-32851 | | 2/2008 |
| JP | 2008-107609 | | 5/2008 |
| JP | 2008-158018 | | 7/2008 |

* cited by examiner

ELECTROPHOTOGRAPHIC IMAGE FORMING METHOD AND APPARATUS WITH A COVER FILM SUPPLYING DEVICE

BACKGROUND OF THE INVENTION

1. Field of the Invention

The present invention relates to an electrophotographic image forming method and an electrophotographic image forming apparatus.

2. Discussion of the Background

Electrophotographic image forming apparatus have been broadly used. Such electrophotographic image forming apparatus use the Carlson process, which uses a latent image bearing member and in which a toner image is formed on a receiving material (such as plain papers) by repeating charging, imagewise light irradiating, developing, transferring, cleaning and initializing processes and the toner image is then heated to be fixed to the receiving material, resulting in formation of a visual image. Thus, the cleaning process is essential for the Carlson process.

Recently, so-called cleaner-less image forming apparatus which reuse the toner collected in the cleaning process have been used. In such cleaner-less image forming apparatus, the surface of an image bearing member bearing residual toner particles thereon even after the transfer process is charged and then subjected to the imagewise light irradiation process to form an electrostatic latent image thereon without performing the cleaning process before the charging process. The electrostatic image formed on the image bearing member is developed by a developing device while unnecessary toner particles among the residual toner particles are collected by the developing device. Thus, the image forming apparatus simultaneously perform the developing process and cleaning process. A published unexamined Japanese patent application No. 2008-032851 discloses such a cleaner-less image forming apparatus.

Although such cleaner-less image forming apparatus do not use a cleaning member, the apparatus typically use another member (such as toner charge controlling members) instead of a cleaning member. The reason therefor is as follows.

Specifically, residual toner particles on an image bearing member include toner particles having charges with the opposite polarity and toner particles having relatively small particle diameters. Therefore, such residual toner particles cannot be used for the development as they are. Therefore, it is necessary to provide, for example, a member configured to impart a charge with the normal polarity to the residual toner particles instead of a cleaning member. In addition, in the transfer process, toner particles having relatively large particle diameters are mainly transferred to a receiving material and toner particles having relatively small particle diameters tend to remain on the image bearing member. Therefore, in order to prevent occurrence of a problem in that toner particles having relatively small particle diameters remain on an image bearing member, polymerization toner, which has sharp particle diameter distribution, is often used for such cleaner-less image forming apparatus.

However, even when using such techniques in that a toner charge controlling member is used and/or polymerization toner is used, residual toner particles on an image bearing member cannot be fully removed therefrom.

Because of these reasons, the inventors recognized that there is a need for a technique of keeping the surface of an image bearing member clean after a transfer process in a cleaner-less image forming apparatus.

SUMMARY OF THE INVENTION

As an aspect of the present invention, an image forming apparatus performing no cleaning process is provided. The image forming apparatus includes:

a latent image bearing member having a moving surface;

a charging device configured to charge the surface of the latent image bearing member at a charging position;

a latent image forming device configured to form an electrostatic latent image on the surface of the latent image bearing member at a latent image forming position;

a developing device configured to supply toner to the electrostatic latent image at a development position to form a toner image on a surface of a cover film covering the surface of the latent image bearing member;

a cover film supplying device configured to supply the cover film to the surface of the latent image bearing member at a cover film supplying position located on an upstream side from the development position relative to the moving direction of surface of the latent image bearing member so that the surface of the latent image bearing member is covered with the cover film and the toner image is formed on the surface of the cover film covering the surface of the latent image bearing member; and a cover film separating device configured to separate the cover film bearing the toner image thereon from the surface of the image bearing member before the cover film bearing the toner image thereon reaches the cover film supplying position.

As another aspect of the present invention, an image forming method performing no cleaning process is provided. The image forming method includes:

charging a moving surface of a latent image bearing member;

forming an electrostatic latent image on the surface of the latent image bearing member;

developing the electrostatic latent image by supplying toner thereto to form a toner image on a surface of a cover film covering the surface of the latent image bearing member at a developing position;

supplying the cover film to the surface of the latent image bearing member at a cover film supplying position located on an upstream side from the development position relative to the moving direction of the surface of the latent image bearing member so that the surface of the latent image bearing member is covered with the cover film and the toner image is formed on the surface of the cover film covering the surface of the latent image bearing member; and separating the cover film bearing the toner image thereon from the surface of the latent image bearing member before the cover film bearing the toner image thereon reaches the cover film supplying position.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Hereinafter, the image forming apparatus of the present invention will be explained by reference to drawings. The below-mentioned examples are provided for the purpose of illustration only and are not intended to be limiting.

At first, a first example of the image forming apparatus of the present invention will be explained by reference to drawings.

Figure 2:
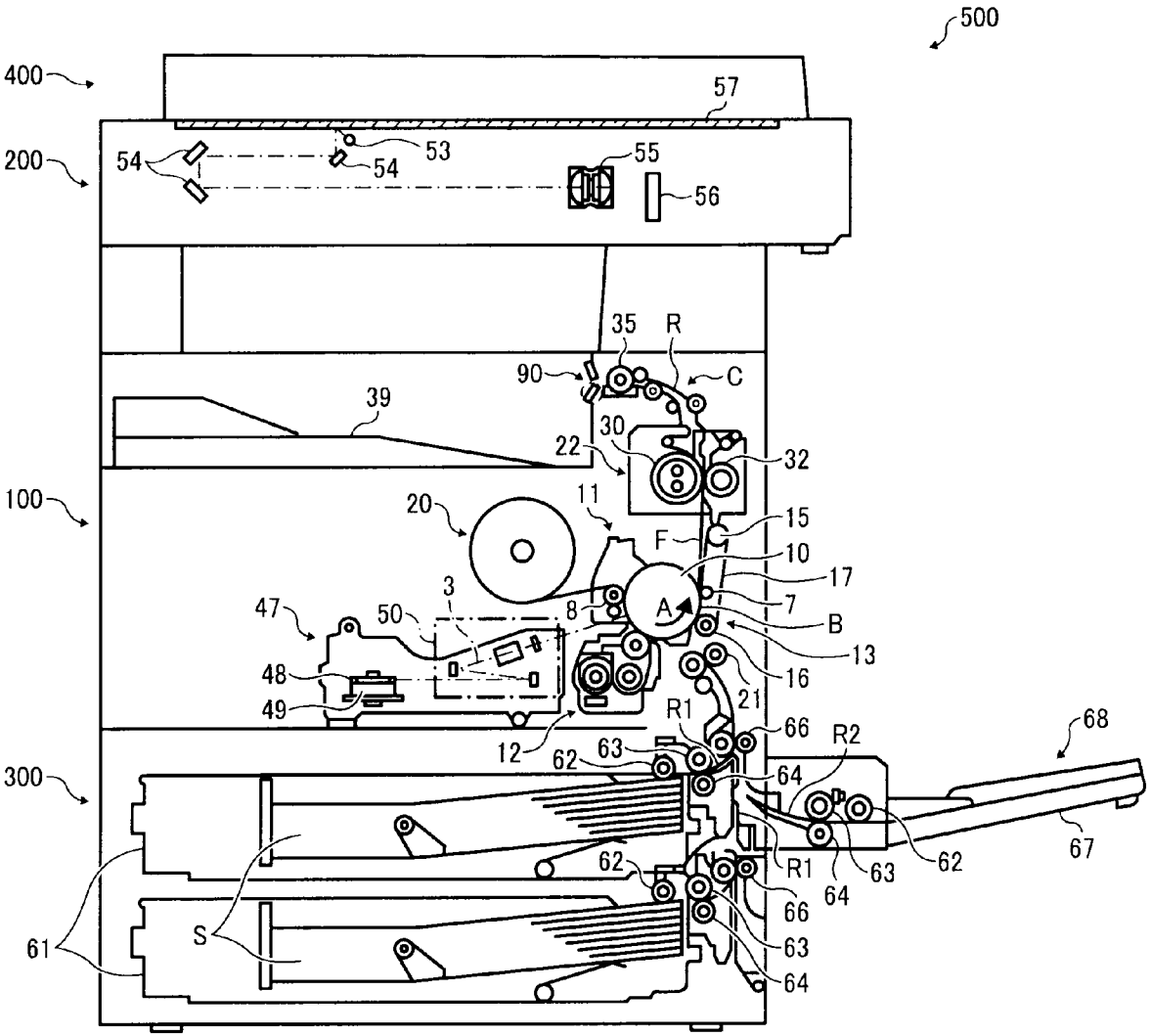
FIG. 2 is a schematic view illustrating the entire of the first example.

FIG. 2 is a schematic view illustrating the entire of the first example of the image forming apparatus (i.e., a copier).

A copier 500 includes a sheet bank 300 configured to contain and feed sheets of receiving materials, a main body 100 which is located above the sheet bank 300 and which forms a visual image on a sheet S of a receiving material, an image reading device 200 which is located above the main body 100 and which reads image information of an original document, and an automatic document feeder 400 which is located above the image reading device 200 while being openable and closable (i.e., rotatable in an up and down direction on an axis thereof located on the backside of the copier) and which automatically feeds original documents one by one to the image reading device 200.

The main body 100 includes a photoreceptor drum 10 serving as a latent image bearing member configured to bear an electrostatic latent image thereon.

Figure 1:
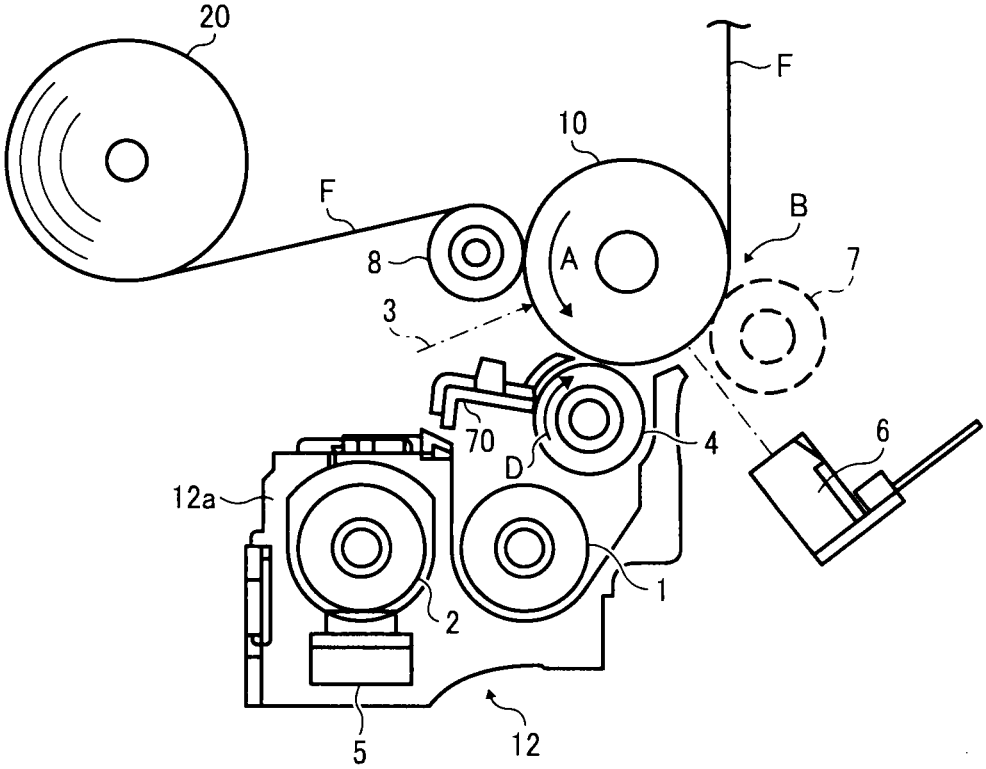
FIG. 1 is a schematic view illustrating the image forming section of a first example of the image forming apparatus of the present invention.

FIG. 1 is a schematic view illustrating the image forming section of the first example of the image forming apparatus. Referring to FIGS. 1 and 2, a charging device 11 having a charging roller 8 configured to charge the surface of the photoreceptor drum, a developing device 12 configured to develop an electrostatic latent image on the photoreceptor drum 10 with a developer including a toner to form a toner image on the photoreceptor drum, and a transferring device 13 configured to transfer the toner image onto a receiving material sheet, are provided around the photoreceptor drum from an upstream side relative to a rotation direction A of the photoreceptor drum indicated by an arrow. In this regard, the copier 500 does not include a cleaning device configured to clean the surface of the photoreceptor drum 10.

The developing device 12 has a developing roller 4 configured to adhere a toner to an electrostatic latent image on the photoreceptor drum 10 to form a toner image on the photoreceptor drum.

The transfer device 13 includes a transfer belt 17 which is rotated while tightly stretched by vertically disposed first and second rollers 15 and 16. The transfer belt 17 is in pressing contact with the surface of the photoreceptor drum 10 at a transfer position B. At the transfer position B, a transfer roller 7 is arranged so as to be opposed to the photoreceptor with the transfer belt 17 therebetween.

A cover film supplying device 20 configured to supply a cover film F to the surface of the photoreceptor drum 10 is provided on the left side of the charging device 11 so that the surface of the photoreceptor drum is covered with the cover film at a position on an upstream side from the development position. The cover film supplying device 20 supplies unused portion of the cover film to the photoreceptor drum 10 with movement of the surface of the photoreceptor drum.

In addition, the main body 100 includes a sheet feeding device C configured to vertically feed the sheet S, which has been fed from a sheet cassette 61 (to be explained later) in the sheet bank 300, to a copy stacking position through the transfer position B. The sheet feeding device C includes a sheet supply passage R1, a manual sheet supply passage R2 and a sheet feeding passage R.

A pair of registration rollers 21 is provided at an upstream side from the photoreceptor drum 10 relative to the sheet feeding direction. In addition, a heat fixing device 22 is provided on a downstream side from the photoreceptor drum 10 relative to the sheet feeding direction. The heat fixing device 22 includes a heating roller 30 serving as a heating member, and a pressing roller 32 serving as a pressing member.

The main body 100 further includes a discharging roller 35, which is configured to discharge the sheet S bearing a visual image (i.e., copy sheet) and which is located on a downstream side from the heat fixing device 22 relative to the sheet feeding direction, and a stacking section 39 on which copy sheets are to be stacked.

Further, the main body 100 includes a laser writing device 47, which is configured to irradiate the photoreceptor drum 10 with a laser beam to form an electrostatic latent image on the photoreceptor drum and which is located on the left side of the developing device 12. The laser writing device 47 includes a laser diode (not shown), a polygon mirror 48 configured to scan the photoreceptor drum with a laser beam 3 emitted by the laser diode, a motor 49 configured to drive the polygon mirror, and an optical system 50 including an fθ lens, etc.

The image reading device 200 includes a light source 53, plural mirrors 54, focusing lenses 55, and an image sensor 56 such as CCDs. In addition, the image reading device 200 has a glass plate 57 on the upper surface thereof, on which an original document to be copied is set.

The automatic document feeder 400 located on the glass plate 57 has an original document setting table (not shown) on which a document is set, and an original document stacking tray (not shown) on which an original document whose image has been read is discharged. In addition, the automatic document feeder has a sheet feeding device having an original document passage through which an original document is fed from the original document setting table to the original document stacking tray via the glass plate 57 of the image reading device 200. The sheet feeding device has plural feed rollers (not shown) for feeding an original document.

The sheet bank 300 has plural sheet cassettes 61, which are vertically disposed and which are configured to contain sheets of a receiving material such as transfer papers and overhead projection (OHP) films. Each of the sheet cassettes 61 has a start roller 62, a feed roller 63 and a separation roller 64. The sheet supply passage R1 leading to the sheet feeding passage R is provided on the right side of the plural sheet cassettes 61. The sheet supply passage R1 has plural sheet feed rollers 66 for feeding the sheet S by applying a feeding force to the sheet S by rotating.

On the right side of the main body of the copier 100, a manual paper feeding section 68 is provided. The manual paper feeding section 68 has an openable and closable manual tray 67, and the manual sheet supply passage R2 for feeding the sheet S to the sheet feeding passage R. Similarly to the sheet cassette 61, the manual tray 67 has the start roller 62, feed roller 63 and separation roller 64.

Next, the copying operation of the copier 500 having the above-mentioned configuration will be explained. At first, a main switch (not shown) of the copier is turned on. An original document is set on the original document setting table of the automatic document feeder 400. In a case where the original is a book or the like, the page of the book to be copied is directly set on the glass plate 57 after the automatic document feeder 400 is opened, followed by closing the automatic document feeder to press the book toward the glass plate.

When a start button is pushed, the document set on the automatic document feeder 400 is fed so as to be set on the glass plate 57 after fed through the original document passage, and the image of the original document is read by the image reading device 200, followed by discharging the original document to the original document stacking tray. When an original document is directly set on the glass plate 57, the image reading device 200 is driven to read the image of the original document.

When the image reading device 200 is driven, the image reading device moves the light source 53 along the glass plate 57 so that the light emitted from the light source 53 is reflected from the surface of the original document, and the reflected light is further reflected from plural mirrors 54 to enter into the image sensor 56 via the focusing lenses 55. Thus, the image of the original document is read by the image sensor 56.

At the same time, the photoreceptor 10 is rotated by a photoreceptor driving motor (not shown) to perform an electrostatic latent image forming process. In the electrostatic latent image forming process, the photoreceptor 10 is charged by the charging roller 8 of the charging device 11 while the surface of the photoreceptor is covered with the cover film F supplied from the cover film supplying device 20. Next, the laser writing device 47 irradiates the charged photoreceptor with laser light according to the image of the original document read by the image reading device 200, resulting in formation of an electrostatic latent image on the photoreceptor 10. In this regard, the image writing process (light irradiating process) is performed on the photoreceptor 10 through the cover film F. Next, the developing device 12 develops the electrostatic latent image on the photoreceptor 10 with a toner. In this regard, since the cover film F is present between the photoreceptor 10 and the developing roller 4, a toner image corresponding to the electrostatic latent image is formed on the cover film F. Thus, the electrostatic latent image is visualized.

On the other hand, when the start button is pressed, the sheet S having the selected size is fed by the start roller 62 from one of the sheet cassettes 61 in the sheet bank 300. The sheet S is further fed by the supply roller 63 while separated from the following sheet by the separation roller 64 so as to enter into the sheet supply passage R1 one by one. The sheet S is then fed by the sheet feed roller 66 so as to enter into the sheet feeding passage R. When the sheet S hits the pair of registration rollers 21, the sheet S is stopped by the registration rollers. The pair of registration rollers timely starts to feed the sheet S toward the right side of the photoreceptor so that the toner image formed on the cover film F faces the sheet S at the transfer position B.

When an image is formed on the sheet S set on the manual tray 67, the sheet S is fed from the manual tray to the manual sheet supply passage R2. Next, the same image forming operation as that performed on the sheet S fed from the sheet cassettes 61 is performed on the sheet S fed from the manual tray 67. Specifically, the pair of registration rollers 21 timely starts to feed the sheet S toward the right side of the photoreceptor so that the toner image formed on the cover film F faces the sheet S at the transfer position B.

Figure 3:
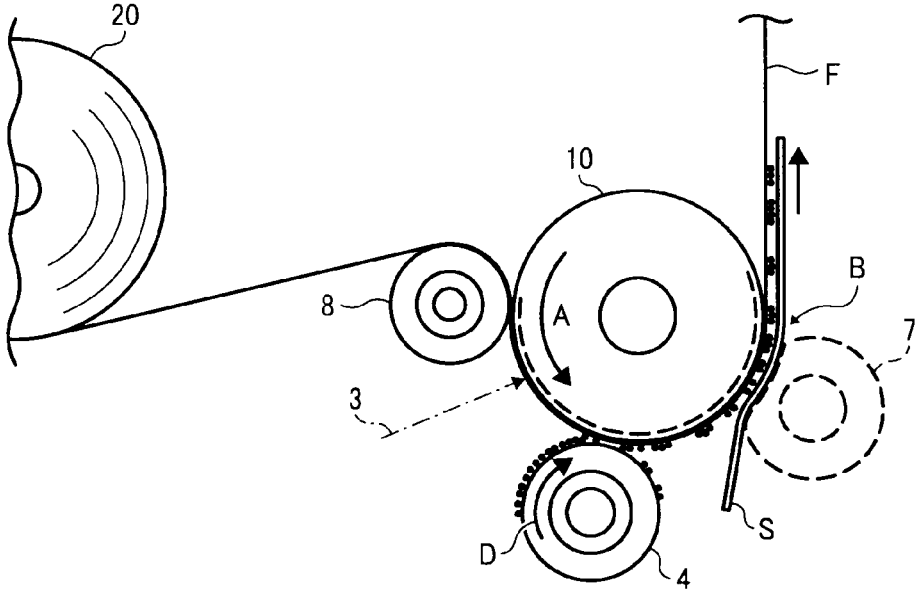
FIG. 3 is a schematic view for explaining how a toner image is transferred onto a receiving material sheet in the first example.

The sheet S thus fed to the right side of the photoreceptor 10 and contacting the toner image on the cover film F is separated from the photoreceptor together with the cover film as illustrated in FIG. 3. In this example, the cover film F is transparent. By separating the combination of the cover film F and the sheet S from the photoreceptor 10, an image in which the toner image is present on the sheet while covered with the cover film is formed.

In this example, the toner image is formed on the cover film F. In addition, at the transfer position B of the copier 500, the cover film F is adhered to the surface of the photoreceptor 10 while adhered to the surface of the sheet S. Therefore, the toner image on the cover film F is transferred onto the sheet S at the transfer position B. In conventional image forming apparatus, the transfer position means a position at which a toner image formed on a photoreceptor is transferred onto a sheet by an electrostatic force or an adhesive force of the toner. However, in this example, the transfer position B means a position at which a toner image is moved from the photoreceptor 10 to the sheet S together with the cover film F.

In this example, the cover film F is adhered to the sheet S by an electrostatic force therebetween. In this regard, an adhesive may be applied onto the surface of the cover film facing the sheet S or the surface of the sheet S facing the cover film so that the cover film is securely adhered to the surface of the sheet S. In addition, by using a toner having a high adhesiveness, the cover film can be securely adhered to the surface of the sheet S by the adhesive force of the toner image.

The cover film F having a roll-form and set on the cover film supplying device 20 is continuous from the cover film supplying device to a cover film cutting mechanism 90. As illustrated in FIG. 2, the cover film cutting mechanism 90 is arranged on a downstream side from the heat fixing device 22 in this copier 500. Since the cover film F is tightly stretched between the transfer position B and the fixing nip of the heat fixing device 22, the cover film F can be separated from the surface of the photoreceptor 10 together with the sheet S. Namely, the configuration of the image forming apparatus (i.e., stretching of the cover film between the transfer position B and the fixing nip) constitutes cover film separating means.

After passing the transfer position B, the photoreceptor 10, from which the cover film is separated and which has a residual potential, is discharged by a discharging device (not shown) so that the residual charge is reduced and the next image forming operation starting from the charging process using the charging device 11 can be well performed thereon.

In this example, since the sheet S is adhered to the cover film F at the transfer position B, the toner image on the cover film is transferred from the photoreceptor to the sheet S while united with the sheet and the cover film. Therefore, the transfer device 13 serves as toner image transferring means.

However, when the attraction between the cover film F and the sheet S is weak before the fixing operation, the sheet S is not adhered to the cover film F at the transfer position B, and thereby the toner image on the cover film is not transferred onto the sheet S. However, when the combination of the cover film F having a toner image thereon and the sheet S is fed to the heat fixing device 22, the toner is fused by the fixing device, and thereby the cover film having a toner image is united with the sheet S. Therefore, even when the sheet S is not adhered to the cover film F at the transfer position B, the toner image formed on the photoreceptor with the cover film therebetween is transferred onto the sheet S by the heat fixing device 22. Thus, the configuration of the image forming apparatus between the transfer position B and the heat fixing device 22 constitutes toner image transferring means. Namely, in this example, the transfer process is defined as the process in which a toner image formed on the photoreceptor 10 with the cover film F therebetween is transferred onto the surface of the sheet S together with the cover film F, and the transferring device 13 and the heat fixing device 22 serve as toner image transferring means.

The sheet S on which the cover film F bearing a toner image is overlaid is then guided to the heat fixing device 22 by the transfer belt 17 and the cover film F to be heated and pressed at the fixing nip formed by the heat roller 30 and the pressure roller 32, resulting in fixation of the toner image on the sheet S and the cover film F.

Thereafter, the combination of the cover film F and the sheet S with the toner image therebetween is discharged on the stacking section 39 by the discharging roller 35 after cut by the cover film cutting mechanism 90.

Thus, a copy in which a fixed image is formed on the sheet S while covered with the cover film is stacked on the stacking section 39.

Although the transfer belt 17 is omitted from FIG. 3, the copier 500 has the transfer belt as illustrated in FIG. 2. Namely, the transfer roller 7 is contacted with the photoreceptor 10 with the transfer belt 17 and the cover film F therebetween.

Suitable materials for use as the cover film F include wrapping films for wrapping foods and the like, which have a good combination of transparency, lightweight, heat resistance (for example, from −60° C. to +150° C.) and water resistance and which have a thickness on the order of ten micrometers. Specific examples of such wrapping films include films of cellophane, polyethylene terephthalate (PET), drawn polypropylene (OPP), nylon (NY), polyethylene (PE), polypropylene (PP), polyvinylidene chloride (PVDC), polyvinyl alcohol (PVA), polyvinyl chloride (PVC), polymethyl pentene (PMP), etc. In addition, complex wrapping films such as combinations of polyethylene and polypropylene (PE+PP) and combinations of nylon and polyethylene (NY+PE) can also be used.

The cover film is not limited to the above-mentioned films, and any known films having a good combination of light transmitting property; static electricity retaining property; stress resistance; film maintainability; heat resistance; and water resistance can be used for the cover film.

Next, the operation of supplying the cover film F will be explained by reference to FIGS. 1 and 3. FIG. 3 is an explanatory view illustrating the transfer position B of the image forming section illustrated in FIG. 1, wherein the cover film F faces the sheet S.

The cover film F supplied from the cover film supplying device 20 is supplied to the surface of the photoreceptor 10 after contacting the surface of the charging roller 8. Namely, in this example, the position at which the charging roller 8 faces the photoreceptor 10 is the cover film supplying position. The cover film F is fed to the downstream side while adhered to the surface of the photoreceptor 10 by the pressing force of the charging roller 8 and the bias charge applied to the charging roller to charge the photoreceptor, thereby evenly charging the surface of the photoreceptor 10. In this regard, since the photoreceptor 10 is rotated, the roll-form cover film set on the cover film supplying device 20 is sequentially fed. Next, the laser writing device 47 irradiates the evenly charged photoreceptor with the light beam 3, resulting in formation of an electrostatic latent image on the photoreceptor 10. The thus formed electrostatic latent image is developed by the developing device 12, resulting in formation of a toner image on the cover film F. After the toner image on the cover film F is overlaid on the sheet S, the combination of the cover film and the sheet is fed to the heat fixing device 22 so that the toner image is fixed to the sheet and the cover film.

Figure 4:
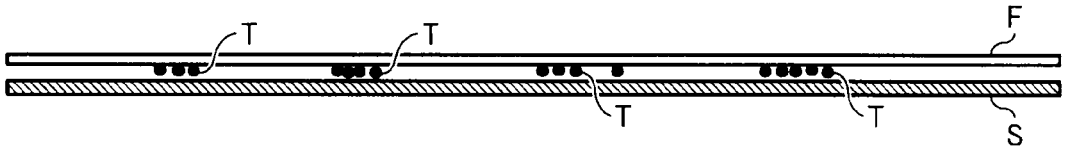
FIG. 4 is a schematic cross-sectional view illustrating a receiving material sheet on which a cover film is overlaid with a toner image therebetween.

FIG. 4 illustrates the cross-section of the combination of the cover film F and the sheet S with a toner image T therebetween. Referring to FIG. 4, the toner image T is formed on the cover film F, i.e., the toner image T is firmly attached to the surface of the cover film F. In this case, the toner image is supported by the sheet S while covered with the cover film F, which is a thin and transparent film. Therefore, the toner image has dramatically improved texture. In order that a toner image formed on a sheet by a conventional image forming apparatus has the same texture as that of the toner image produced by this example, the toner image has to be sufficiently fused to an extent such that the toner image (toner layer) forms a toner film. In contrast, the toner image produced by this example of the image forming apparatus has good texture even when the toner layer does not well form a toner film and a small space remains between the toner layer and the sheet.

The copier 500, which is an example of the present invention, is a monochrome image forming apparatus having one photoreceptor and one developing device. However, the image forming apparatus of the present invention is not limited thereto, and may be a full color image forming apparatus having one photoreceptor and four developing devices. Namely, the configuration such that a cover film is supplied to the surface of the photoreceptor can be applied to such a full color image forming apparatus. Since full color images typically have a large image area proportion, color toners are present on the entire surface of a sheet, and therefore the entire of the cover film and the sheet can be fixed to each other by the color toners after the color toners are heated by a fixing device. In addition, the color toner image covered with the cover film has as good texture as photographic images.

A published unexamined Japanese patent application No. (hereinafter referred to as JP-A) 2008-107609 discloses an electrophotographic image forming apparatus which produces a toner image covered with a transparent film. Specifically, the image forming apparatus adheres a transparent film to a toner image so that the toner image has photographic image qualities. More specifically, the image forming apparatus performs a first process in which a second sheet which is not transparent is supplied; a second process in which a toner image is transferred onto the second sheet; a third process in which a first sheet having a support sheet and a transparent layer located thereon is overlaid on the toner image on the second sheet in such a manner that the transparent layer faces the toner image, to integrate the first sheet with the second sheet; and a fourth process in which the support sheet is separated from the first sheet to produce a toner image covered with the transparent layer. In this regard, the third process including a fixing process is performed while the fourth process is performed at the same time.

Although this image forming apparatus produce a toner image covered with a transparent sheet, a cleaning operation has to be performed on the image bearing member such as photoreceptors. Namely, the image forming apparatus is not a cleaner-less image forming apparatus. In addition, the image forming processes are complex, and the first sheet is also complex.

In contrast, the copier 500, which is an example of the present invention, can produce a final image (i.e., a toner image covered with a transparent sheet) relatively easily. In addition, a cleaning device is not necessary for the photoreceptor 10.

In the copier 500, the cover film F covers the surface of the photoreceptor 10 in a range of from the development position in which the developing roller 4 of the developing device 12 faces the surface of the photoreceptor 10 to the transfer position B at which the toner image is transferred onto the sheet S. At the transfer position B, the cover film F is separated from the surface of the photoreceptor 10 together with the toner image. On the other hand, the cover film supplying device 20 supplies unused portion of the cover film roll to the non-charged surface of the photoreceptor. Since the copier 500 has such configuration, a toner image is formed on the cover film F while the toner image is not directly contacted with the surface of the photoreceptor 10. Therefore, a cleaning device is not necessary for the photoreceptor 10.

JP-A 2008-032851 mentioned above discloses a cleaner-less image forming apparatus in which a cleaning device is not necessary for the photoreceptor because toner (residual toner) remaining on the photoreceptor without being transferred is collected in the developing process. In this background image forming apparatus, the charging efficiency of the residual toner is enhanced and toner present on the background area of an image is efficiently removed to improve the image qualities. In this background image forming apparatus, a charging roller, a developing device, a primary transfer roller, and an auxiliary charging device are arranged around a photoreceptor drum. In the developing device, negatively charged toner is transported from a rotating sleeve to a toner image forming area while the toner on a no-image forming area (i.e., background area of image) is transported to the rotating sleeve to perform a developing process and a cleaning process at the same time.

In this background image forming apparatus, a charging brush serving as the auxiliary charging device is arranged on a downstream side from the primary transfer roller, and a voltage of −1,000V is applied thereto to negatively charge the residual toner present on the surface of the photoreceptor drum. In addition, a bias voltage of 700V is applied to a portion of the intermediate transfer belt, which portion is located between two toner images, to prevent occurrence of problems caused by the residual toner, by the primary transfer roller, wherein the bias voltage is higher than the primary transfer bias voltage (500V) applied to an image portion of the intermediate transfer belt by the primary transfer roller.

Although the background image forming apparatus disclosed in JP-A 2008-032851 has no cleaning device, the image forming apparatus uses an alternative such as charging brushes. The reason therefor is as follows. Specifically, residual toner is present while being adverse to the transfer bias voltage, which is applied by the transfer device to adhere normally charged toner to a receiving material or the intermediate transfer belt. Therefore, residual toner has a low charge quantity or a polarity opposite to the normal polarity of the toner. Accordingly, residual toner cannot be easily collected by dynamic development performed by the developing member unlike the normally charged toner. Particularly, when images are formed under high temperature and high humidity conditions or long-term operation conditions, or images having high a high image area proportion are formed while a large amount of fresh toner is supplied to the developing device, the content of toner having a low charge quantity increases, and thereby such toner is adhered to the surface of the image bearing member in a large amount. This is because the toner in the developing device has a low charge quantity and in addition it is difficult to impart a normal charge to the toner under such severe conditions. When such toner is adhered to the image bearing member in a large amount, the charging process and light irradiating process cannot be well performed on the image bearing member, resulting in deterioration of the image qualities.

Therefore, the background cleaner-less image forming apparatus needs an auxiliary charging device, which is provided on a downstream side from the transfer device to impart a normal charge to the residual toner, which remains on the image bearing member without being transferred. Thus, an alternative to a cleaning device (i.e., an auxiliary charging device) is provided in the background image forming apparatus. In addition, even when such an alternative is provided, residual toner present on an image bearing member cannot be sufficiently removed by the alternative.

A published utility model application No. 03-065146 discloses another image forming apparatus, which has no photoreceptor cleaning device and in which a film sheet is supplied to be overlaid on a recording medium to form an image. This apparatus forms a latent image by imagewise irradiating a film sheet which includes microcapsule and which serves as a photosensitive and pressure sensitive material, and then overlaying a color developing paper serving as the recording medium on the film sheet. The combination of the color developing paper and the film sheet is then fed so as to pass through a pressure developing device. In this regard, the microcapsule in the film sheet is destroyed, and the dye precursor present in the non-irradiated portion of the film sheet is reacted with the coloring agent present on the surface of the color developing paper, resulting in formation of a colored image on the color developing paper (i.e., recording paper). The recording paper is then heated by a heat fixing device so that the coloring reaction is further accelerated, resulting in formation of a final image.

This image forming apparatus forms an image by overlaying a sheet and a recording paper, but the apparatus does not use electrophotography, i.e., the apparatus does not use toner. Therefore, it is not necessary for the apparatus to use a cleaning device. Namely, this background image forming apparatus is different from the image forming apparatus (copier 500) of the present invention using electrophotography. In addition, in the background image forming apparatus, the film sheet is separated from the recording paper after an image is formed on the recording paper. Therefore, this background image forming apparatus is different in this regard from the copier 500.

In contrast, the copier 500 according to the present invention develops an electrostatic latent image on the photoreceptor 10 with toner with the cover film F therebetween, and then separates the cover film bearing a toner image thereon from the photoreceptor. Therefore, toner does not remain on the surface of the photoreceptor 10. Accordingly, the copier needs no cleaning device.

In addition, since the cover film protects the photosensitive layer of the photoreceptor 10, the photosensitive layer is hardly abraded while hardly affected electrically. Therefore, durability of the photoreceptor 10 can be dramatically improved.

Further, images having a transparent film thereon can be easily prepared. Particularly, since a toner image is formed on the side of the transparent film while sandwiched by the film and a support sheet, the resultant image has a good combination of clearness and texture.

Furthermore, by setting a roll of the cover film in the cover film supplying device 20, the cover film F can be automatically supplied to the surface of the photoreceptor 10. It is necessary that the cover film F covers the surface of the photoreceptor 10 at a position on an upstream side from the developing position. Since the charging process and light irradiating process are performed before the developing process, the cover film supplying process is preferably performed at the charging process or light irradiating process. The cover film supplying device 20 can continuously supply the cover film F to the surface of the photoreceptor 10 as image forming processes proceed. The cover film F bearing a toner image thereon is overlaid on a receiving material such as recording paper, resulting in formation of an image.

By forming an image as mentioned above in this example, the image has as good image qualities as photographic images.

Next, the developing device 12 of the copier 500 for developing an electrostatic latent image formed on the photoreceptor 10 will be explained.

The developing device 12 is a two-component developing device using a two-component developer including a toner and a carrier. The copier has a toner bottle (not shown) for containing the toner used for developing. The toner in the toner bottle is supplied to a developer containing portion 12*a* (i.e., casing) of the developing device 12 through an opening of the toner bottle by a toner supplying device (not shown). At the developer containing portion 12*a*, the toner (supplemental toner) is added to the developer including the toner and the carrier. The mixture of the supplemental toner and the developer (the mixture is hereinafter referred to as developer) is agitated by a second feed screw 2 having a spiral form while fed to the backside (downstream side of the screw 2) in a direction perpendicular to the paper on which FIG. 1 is illustrated. Since a second passage having the second feed screw 2 is connected with a first passage, which has a first feed screw 1, at the front side and the backside thereof in the direction perpendicular to the paper on which FIG. 1 is illustrated, the developer fed to the downstream side of the second feed screw 2 is transferred to the upstream side of the first passage. The developer is then fed to the downstream side of the first feed screw 1 (i.e., to the front side in the direction perpendicular to the paper on which FIG. 1 is illustrated). The developer thus fed to the downstream side of the first feed screw 1 is then transferred to the upstream side of the second passage. Thus, the developer is circulated in the developing device 12 while agitated.

The developer thus circulated and present in the first passage is drawn to the surface of the developing roller 4 by the magnetic force of a magnet arranged in the developing roller. The developer on the developing roller 4 is fed in a direction D (i.e., clockwise) and regulated by a doctor 70 so as to form a developer layer having a predetermined thickness while the toner and the carrier in the developer are frictionally charged.

The developer consisting of the thus charged magnetic carrier and toner forms magnetic brush on the developing roller 4 due to the maximum magnetic force of a main pole of the developing roller, and the magnetic brush contacts the cover film F. Since a bias voltage is applied to the developing roller 4, the charged toner in the developer is selectively adhered to an electrostatic latent image on the photoreceptor 10. The toner concentration in the developer present in the developer containing portion 12*a* is watched by a toner concentration sensor 5. When the toner concentration is low, a toner supplying device (not shown) is driven to supply the toner in the toner bottle to the developing device to control the toner concentration at a predetermined concentration.

In addition, an electrostatic latent image having a predetermined reference pattern is formed on the photoreceptor 10 and the latent image is developed with the developer to form a reference toner image on the cover film F covering the photoreceptor. The reflection density of the reference toner image is measured with a pattern density sensor 6. On the basis of the measured reflection density and toner concentration, the toner supplying device starts to supply the toner in the toner bottle to the developing device.

Referring to FIG. 1, the toner concentration sensor 5 is arranged below the second feed screw 2 feeding the developer. The toner concentration sensor measures the magnetic permeability of the developer to determine the concentration of the toner in the developer. Specifically, when the toner concentration decreases, the magnetic permeability of the developer increases because the carrier achieves a dense state. Therefore, when the magnetic permeability is greater than a predetermined value (threshold), it is judged that the toner concentration is lower than a predetermined concentration, and a controller (not shown) of the copier outputs a signal to the toner supplying device to supply the toner until the toner concentration becomes the predetermined concentration.

Thus, the image density of the reference toner image formed on the cover film F is controlled to fall in a predetermined range by performing the toner supplying operation. A judging mechanism (not shown) judges whether the toner in the toner bottle is exhausted on the basis of the toner concentration detected by the toner concentration sensor 5 and the reflection density of the reference toner image detected by the pattern density sensor 6.

In this example, the toner is supplied from the toner bottle. The toner for use in the copier 500 is preferably a toner including a polyester resin, but is not limited thereto.

Next, the toner for use in the copier 500 will be explained.

The toner preferably includes a polyester resin. Suitable polyester resins include unmodified polyester resins, which can be prepared by subjecting a polyhydric alcohol and a polybasic acid (such as combination of a diol with a dicarboxylic acid, a dicarboxylic acid having a diester group $(—COOR)_2$ or a diester compound of carboxylic acid) to a dehydration (or dealcoholization) condensation reaction. In addition, the toner can further include a modified polyester resin prepared by subjecting a diisocyanate having two isocyanate groups and a compound having an active hydrogen (particularly, diols, dioic acids, or compounds having a hydroxyl group (—OH) and a carboxyl group (—COOH)).

When a modified polyester resin (urea-modified polyester resin) is prepared, the equivalence ratio ([NCO]/[OH]) of the isocyanate group of the polyisocyanate to the hydroxyl group of the polyester resin to be reacted with the polyisocyanate is generally from 5/1 to 1/1, preferably from 4/1 to 1.2/1, and more preferably from 2.5/1 to 1.5/1.

When the toner includes an unmodified polyester resin and a urea-modified polyester resin (serving as a prepolymer), the toner has a good combination of low temperature fixability and glossiness of image (particularly when the toner is used for forming full color images). In this regard, the unmodified polyester resin can include a chemical bond other than a urea bond.

It is preferable that the unmodified polyester resin and urea-modified polyester resin are partially compatible with each other (i.e., the polyester resins have similar formulae) to impart a good combination of low temperature fixability and hot offset resistance to the toner.

The weight ratio (U/M) of the unmodified polyester resin (U) to the urea-modified polyester resin (M) is generally from 20/80 to 95/5.

The urea-modified polyester resin preferably used for the toner can include a urethane bond as well as a urea bond. In this regard, the molar ratio (UR/UT) of the urea-modified polyester resin (UR) to the urethane-modified polyester (UT) is 100/0 to 10/90.

In this first example (i.e., copier 500), the toner has a melting point of about 120° C., the fixing temperature is set to 150° C., and the cover film has a heat resistance of not lower than 150° C.

In this first example, after passing the discharging roller 35, the cover film F is cut by the cover film cutting mechanism 90. Specifically, when the front edge of the sheet S passes the cover film cutting mechanism 90 and the rear edge thereof passes the cover film cutting mechanism, the cover film cutting mechanism cuts the cover film F in the direction perpendicular to the feeding direction of the sheet S. Therefore, the cover film F has the same length as the sheet S. In addition, since the cover film is cut at the front and rear ends of the sheet S, the between-paper portion of the cover film, which is not contacted with the sheet S (i.e., which is present between two sheets), is separated from the sheet, and the between-paper portion of the film is discharged on the stacking section 39 similarly to the sheet S.

Any known cutters such as cutters cutting a roll paper in the direction perpendicular to the feeding direction thereof can be used for the cover film cutting mechanism 90. In this example, a rotary cutter is used for the cover film cutting mechanism 90.

In this first example, the cover film F is cut after the fixing device 22. However, the cutting position is not limited thereto. For example, the cover film F can be cut before the fixing device 22.

Figure 5:
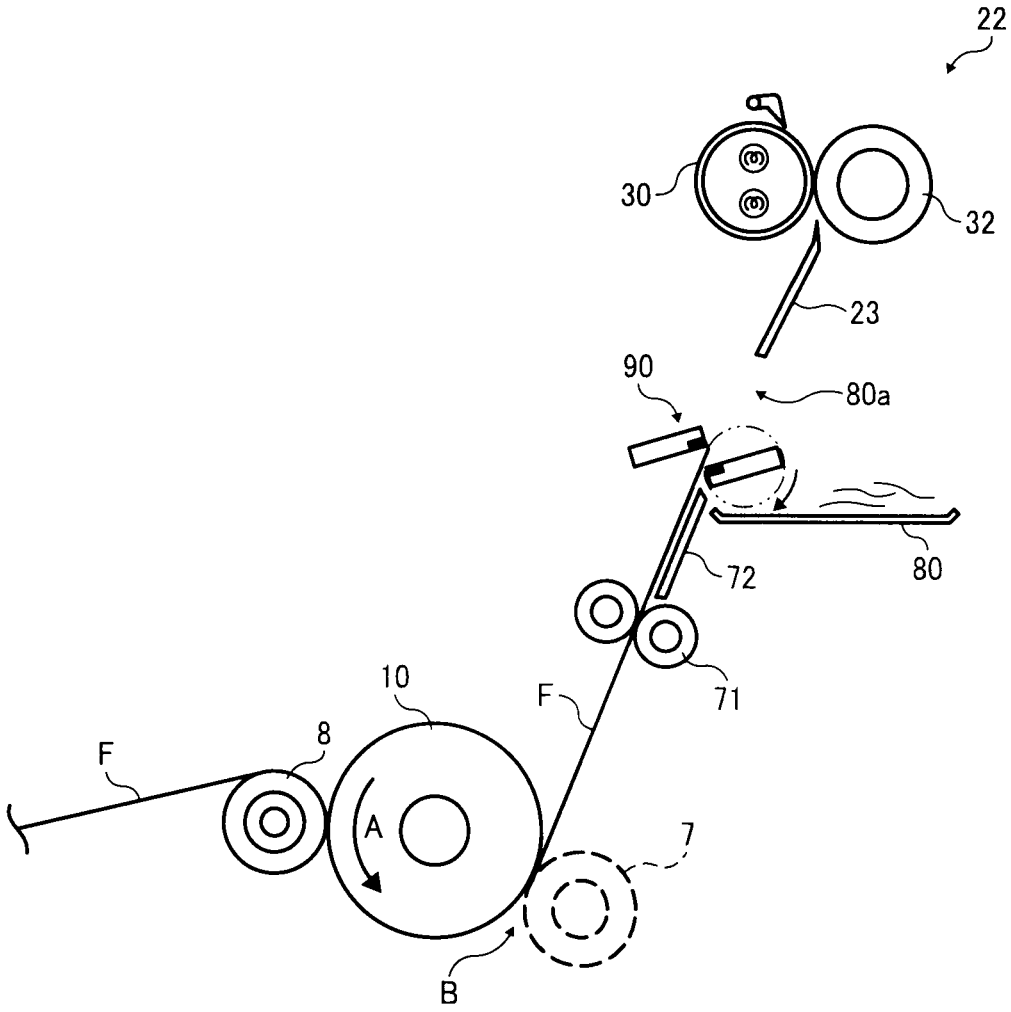
FIG. 5 is a schematic view illustrating a cover film cutting mechanism, which cuts a cover film before a fixing process.

FIG. 5 illustrates another example of the cover film cutting mechanism 90, which cuts the cover film F so as to have the same size as the sheet before the fixing device 22.

In the example illustrated in FIG. 5, after-transfer feed rollers 71 are provided on a downstream side from the transfer position B relative to the sheet feeding direction. The after-transfer feed rollers 71 feed the cover film F or the combination of the cover film and the sheet S while sandwiching the film or the combination. In addition, the cover film cutting mechanism 90 is arranged on a downstream side from the feed roller 71, and a first guide member 72, which guides the cover film F to a position at which the film faces the cover film cutting mechanism 90, is arranged therebetween. Further, a second guide member 23, which guides the sheet S from a position on a downstream side from the first guide member 72 and apart therefrom with a predetermined space 80*a* therebetween to the fixing nip of the fixing device 22. Furthermore, a film piece container 80 for containing cut film pieces (i.e., between-paper portions of the cover film) is provided below the space 80*a*.

Figure 6A:
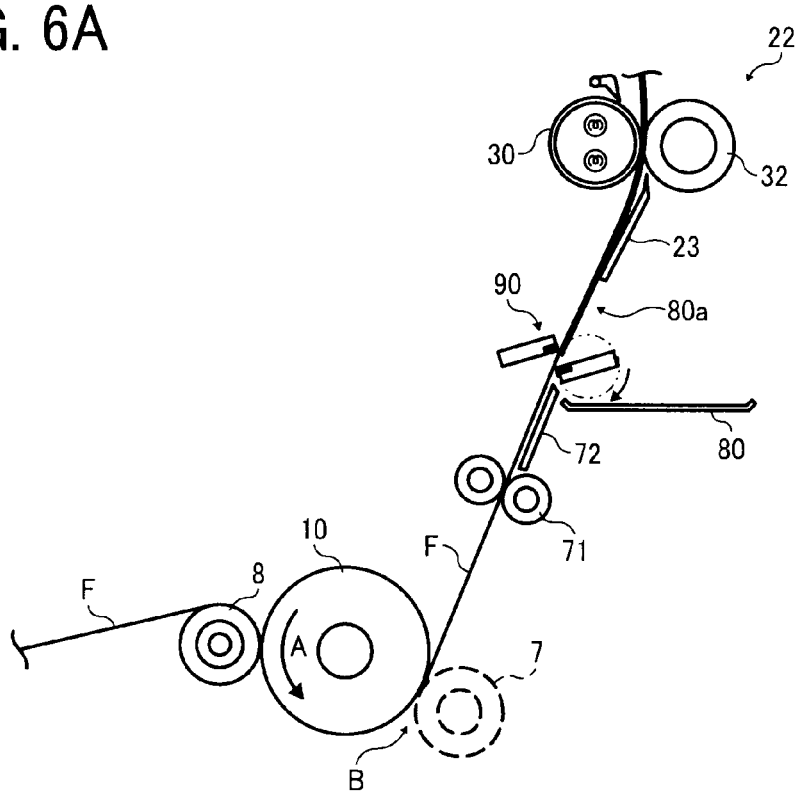
FIG. 6A is a schematic view illustrating a cover film cutting mechanism, which cuts a cover film at a rear edge of a receiving material sheet.
Figure 6B:
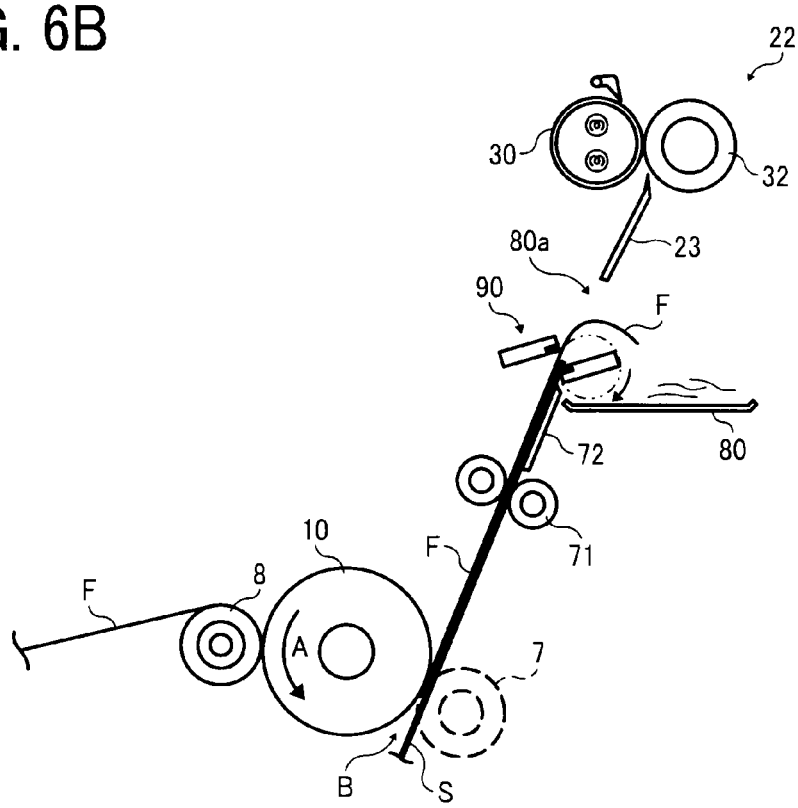
FIG. 6B is a schematic view illustrating a cover film cutting device, which cuts a cover film at a front edge of a receiving material sheet.

FIG. 6 is a view for explaining the way to cut the cover film F using the cover film cutting mechanism 90. Specifically, FIG. 6A illustrates a case where the portion of the cover film corresponding to the rear edge of the sheet S is cut, and FIG. 6B illustrates a case where the portion of the cover film corresponding to the front edge of the sheet S is cut.

When the combination of the cover film F and the sheet S passes the space 80*a*, the tip of the combination can reach the second guide member 23 because the combination has large stiffness, and therefore the combination can be fed to the fixing nip of the fixing device. Therefore, when the combination passes the cover film cutting mechanism 90, and the cover film is cut at a position corresponding to the rear edge of the sheet S, the cut film portion is fed together with the sheet S to the heat fixing device 22 as illustrated in FIG. 6A.

In contrast, when the cover film F without the sheet S passes the space 80*a*, the cover film present on a downstream side from the rear edge of the first guide member 72 in the sheet feeding direction is bent because of having small stiffness, and is fed toward the film piece container 80. Therefore, when only the cover film F passes the cover film cutting mechanism 90, and the cover film is cut at the front edge of the sheet S, the cut film piece is contained in the film piece container 80 as illustrated in FIG. 6B.

After passing the heat fixing device 22, the combination of the cover film F and the sheet S is discharged to the stacking section 39.

By using the cover film cutting mechanism 90 illustrated in FIGS. 5 and 6, the combination of the cover sheet F and the sheet S is discharged on the stacking section 39 and the cut film piece is contained in the film piece container 80. Therefore, the copy sheets can be separated from the cut film pieces.

In the example illustrated in FIGS. 5 and 6, the cover film F is tightly stretched by the nip formed by the pair of after-transfer feed rollers 71 and the transfer nip at the transfer position B. Therefore, the cover film F is separated from the surface of the photoreceptor 10 together with the sheet S. Namely, the configuration of the image forming apparatus of from the nip of the after-transfer feed roller 71 to the transfer nip serves as cover film separating means.

In the copier 500 illustrated in FIG. 2, the cover film supplying device 20 has a roll-shaped cover film and continuously supplies the cover film to the surface of the photoreceptor 10. The configuration such that the cover film F covers the surface of the photoreceptor at least in a range of from the development position to the transfer position B is not limited thereto. For example, the image forming apparatus of the present invention can have configuration such that sheets of the cover film, which has the same size as the sheet S and set in a cover film container, are supplied one by one to the surface of the photoreceptor so that each cover film sheet is electrostatically adhered to an electrostatic latent image formed on the photoreceptor, and then the developing and transferring operations are performed similarly to the first-mentioned example. In this example, the cover film cutting mechanism is not necessary, and the cover film can be saved because cut film pieces are not produced, resulting in cost reduction.

Next, several experiments carried out to confirm that the developing operation can be performed on an electrostatic latent image, which is formed on a photoreceptor while covered with a cover film, will be explained.

[Experiment 1]

In this experiment, an image forming apparatus, IMAGIO MP 5000 from Ricoh Co., Ltd., is used as the image forming apparatus, and a polyvinylidene chloride (PVDC) film (KREWRAP from Kureha Corp.) having a thickness of 10 μm is used as the cover film F.

At first, a sheet of the PVDC film was wound around the peripheral surface of the photoreceptor drum of the image forming apparatus. Next, an image forming operation was performed on the photoreceptor drum without supplying a receiving material sheet (i.e., sheet S). After a toner image was formed on the photoreceptor (on the cover film), the image forming apparatus was stopped. The photoreceptor drum was removed from the image forming apparatus to visually observe the surface of the photoreceptor. As a result, a toner image was formed on the surface of the cover film. When the cover film was released from the photoreceptor and then set on a paper sheet such that the toner image contacts the paper sheet, it was confirmed that the toner image is clear.

[Experiment 2]

In this experiment, an image forming apparatus, IMAGIO MP 5000 from Ricoh Co., Ltd., is used as the image forming apparatus.

After the photoreceptor drum was charged, the photoreceptor drum was removed from the image forming apparatus, and the PVDC film mentioned above was wounded around the peripheral surface of the photoreceptor drum in a dark place. After the photoreceptor drum was attached to the image forming apparatus, the photoreceptor was exposed to imagewise light to form an electrostatic latent image on the photoreceptor, followed by developing the electrostatic latent image to form a toner image on the photoreceptor (cover film). Similarly to Experiment 1, the photoreceptor drum was removed from the image forming apparatus to visually observe the surface of the photoreceptor. As a result, a toner image was formed on the surface of the cover film. When the cover film was released from the photoreceptor and then set on a paper sheet such that the toner image contacts the paper sheet, it was confirmed that the toner image is clear.

[Experiment 3]

In this experiment, an image forming apparatus, IMAGIO MP 5000 from Ricoh Co., Ltd., is used as the image forming apparatus.

A cover film supplying device was set in the image forming apparatus so that the image forming apparatus has such configuration as illustrated in FIG. 2, and a normal copying operation was performed. As a result, it was confirmed that a copy sheet in which a receiving paper is covered with the cover film with a toner image therebetween is stacked on the stacking section.

[Experiment 4]

The procedures of Experiments 1 and 2 were repeated except that a polymethylpentene (PMP) film (CO-OP WRAP from Japanese Consumers' Cooperative Union) having a thickness of 7.5 μm was used as the cover film F. It was confirmed that a toner image is formed on the cover film in each case.

[Experiment 5]

In this experiment, an image forming apparatus, IMAGIO MP 5000 from Ricoh Co., Ltd., is used as the image forming apparatus.

After the photoreceptor drum was charged, the photoreceptor drum was removed from the image forming apparatus, and a semi-transparent intermediate paper having a thickness of 20 μm was wounded around the peripheral surface of the photoreceptor drum in a dark place. After the photoreceptor drum was attached to the image forming apparatus, the photoreceptor was charged and then exposed to imagewise light to form an electrostatic latent image on the photoreceptor, followed by developing the electrostatic latent image to form a toner image on the intermediate paper. In this regard, a receiving material sheet was not supplied. After a toner image was formed on the photoreceptor (on the intermediate paper), the image forming apparatus was stopped. The photoreceptor drum was removed from the image forming apparatus to visually observe the surface of the photoreceptor. As a result, a toner image was formed on the surface of the intermediate paper. When the intermediate paper was released from the photoreceptor and then set on a paper sheet such that the toner image contacts the paper sheet, it was confirmed that the toner image is slightly unclear but character images of the toner image can be read.

In addition, the procedures of Experiments 1 and 2 were repeated except that the three transparent films were used as the cover film. The properties of the transparent films including KREWRAP and CO-OP WRAP used in Experiments 1 and 2 are illustrated in Table 1 below.

TABLE 1

| Film | Nominal upper temperature limit (° C.) | Constituent material | Real thickness (μm) | Nominal thickness (μm) |
|---|---|---|---|---|
| KREWRAP | 140 | PVDC, with fatty acid derivatives and epoxidized vegetable oil | 9.1-9.3 | 10 |
| CO-OP WRAP | 180 | Polymethyl pentene with polybutene-1 | 7.3 | 7.5 |
| Food wrapping film 1 | 110 | Polyethylene (single layer) | 7.5 | 7.5 |
| Food wrapping film 2 | 150 | Polyethylene + polypropylene (five layers) Specific polyethylene and glycerin fatty acid derivative are added. | 4.6 | 5.0 |
| PRINTACK | No data | Polyester | 100 | 100 |

As a result, clear images could be formed on the films except for PRINTACK, which has a thickness of 100 μm. The reason why an image could not be formed on the film is considered to be that the film is too thick, and therefore an electrostatic latent image corresponding to the electrostatic latent image formed on the photoreceptor cannot be formed on surface of the film.

Not only the above-mentioned films, but also other films can be used as the cover film F long as the films have the following properties:

(1) good light transmittance;

(2) good electrostatic latent image formability/retentivity such that an electrostatic latent image corresponding to the electrostatic latent image formed on the photoreceptor can be formed on the surface of the films while retained;

(3) good stress resistance so as to be resistant to a certain degree of stress, i.e., to be able to maintain a film state even when receiving a certain degree of tensile force;

(4) good heat resistance so as to be able to maintain a film state even when heated to a certain degree of temperature; and (5) good water resistance so as not to be dissolved in water.

Since the semi-transparent intermediate paper used in Experiment 5 can transmit light in a certain degree and has a certain degree of electrostatic latent image formability/retentivity, a toner image could be formed thereon.

Next, a second example of the image forming apparatus will be explained.

In the first example mentioned above, the combination of the cover film F and the sheet S is discharged from the copier 500. However, the image forming apparatus of the present invention is not limited thereto. The second example of the image forming apparatus has configuration such that the photoreceptor is covered with a cover film at the development position at the latest, and the cover film is separated from the sheet S after transferring a toner image to the sheet so that only the sheet bearing an image thereon is discharged from the image forming apparatus.

Since the second example is the same as the first example mentioned above except for the transfer operation at the transfer position B and that the cover film is not discharged from the apparatus together with the sheet S, only the different points will be mainly explained.

Figure 7:
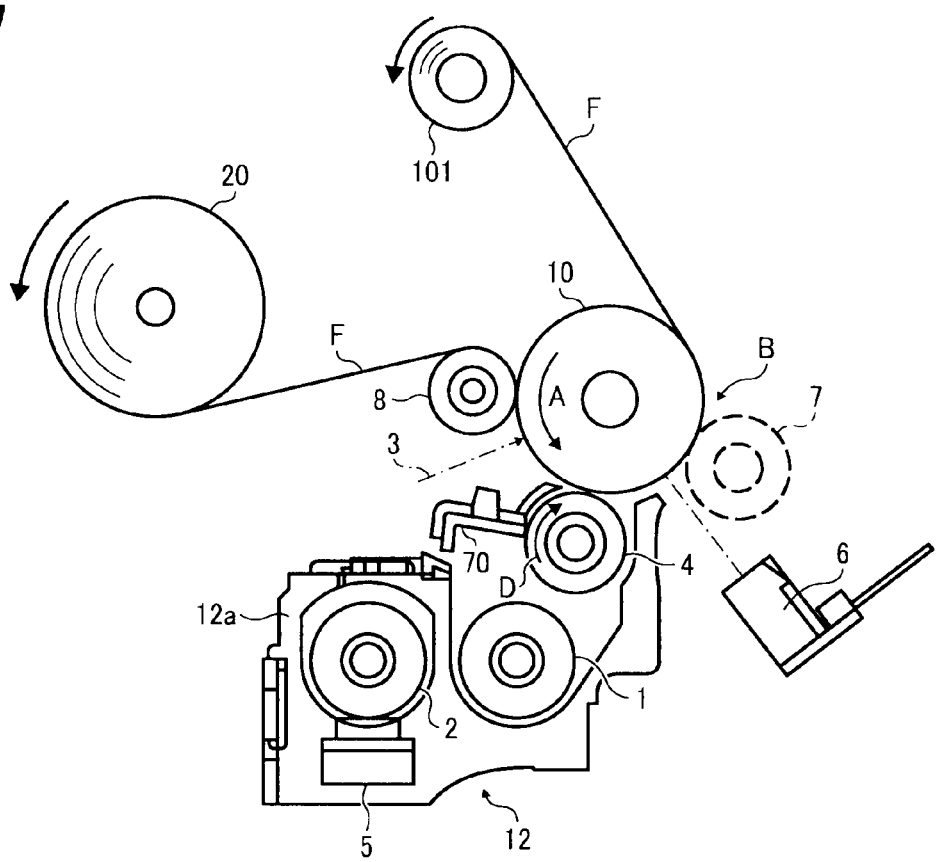
FIG. 7 is a schematic view illustrating the image forming section of a second example of the image forming apparatus of the present invention.
Figure 8:
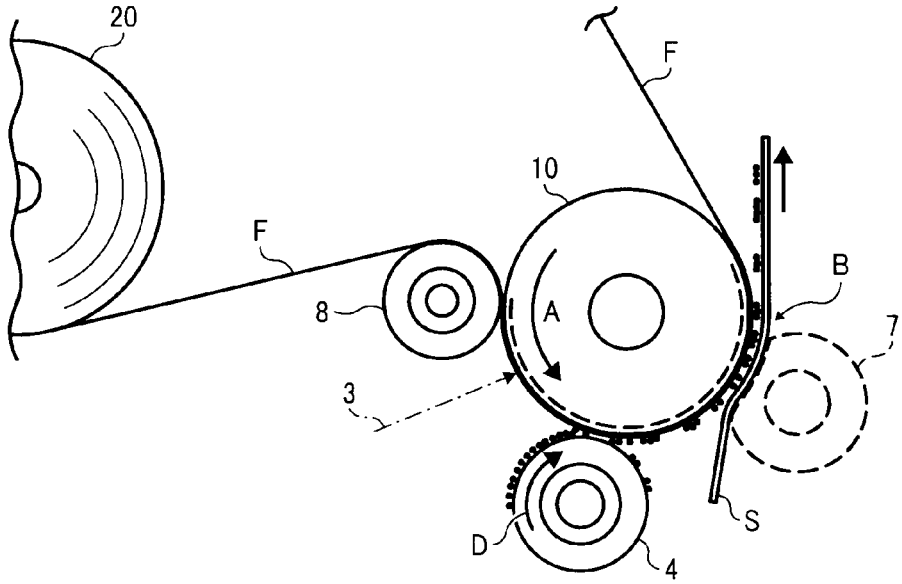
FIG. 8 is a schematic view for explaining how a toner image is transferred onto a receiving material sheet in the second example.

FIG. 7 is a view illustrating the image forming section of the second example, which includes the photoreceptor 10 and neighboring devices, and FIG. 8 is a view for explaining how a toner image is transferred from the cover film to the sheet at the transfer position B of the second example.

The second example of the image forming apparatus of the present invention includes a cover film collection device 101 configured to collect the cover film F after the cover film transfers a toner image to the sheet S at the transfer position B. In this second example, the cover film F is supplied to the charging position, at which the charging roller 8 is opposed to the photoreceptor 10, so as to cover the surface of the photoreceptor similar to the first example. The cover film F is fed to the downstream side while adhered to the surface of the photoreceptor 10 by the pressing force of the charging roller 8 and the bias charge applied to charge the photoreceptor by the charging roller, thereby evenly charging the surface of the photoreceptor 10. In this regard, since the photoreceptor 10 is rotated, the roll-form cover film set on the cover film supplying device 20 is sequentially fed. Next, the laser writing device 47 irradiates the evenly charged photoreceptor with imagewise light 3, resulting in formation of an electrostatic latent image on the photoreceptor 10. The thus formed electrostatic latent image is developed by the developing roller 4 of the developing device 12, resulting in formation of a toner image on the cover film F.

In this regard, a transfer bias voltage is applied to the transfer roller 7 by a bias applying device (not shown) to form a transfer bias between the transfer roller and the photoreceptor 10 at the transfer position B. Therefore, the toner image formed on the cover sheet is transferred onto the sheet S at the transfer position B by the transfer bias as illustrated in FIG. 8. The cover film F is pulled by the cover film collecting device 101 in a direction different from the sheet feeding direction, and thereby the cover film is separated from the sheet S. After being separated from the surface of the photoreceptor 10, the cover film F is collected as a used cover film having a roll-form by the cover film collecting device 101. On the other hand, the sheet S, onto which the toner image is transferred, is fed to the heat fixing device 22 to fix the toner image. The sheet S bearing the fixed toner image is then discharged on the stacking section 39. The second example does not include the cover film cutting mechanism 90 unlike the first example.

Since the surface of the photoreceptor 10 is covered with the cover film F in a range of from the development position to the transfer position B in this second example and the cover film is separated from the surface of the photoreceptor after the transfer position B, the surface of the photoreceptor is not directly contacted with the toner. In addition, since the used cover film is collected by the cover film collecting device 101, the used cover film is not contacted with the surface of the photoreceptor. Therefore, the second example does not need a cleaning device for cleaning the surface of the photoreceptor 10.

Further, in the second example, the used cover film is tightly stretched by the photoreceptor 10 and the cover film collection device 101 so as to be separated from the photoreceptor In this regard, this configuration serves as cover film separating means.

In this example, only the toner image is transferred onto the sheet at the transfer position B unlike the first example. Namely, the cover film F passes the transfer position B while being adhered to the surface of the photoreceptor 10. Thus, the transferring device 13 serves as toner image transferring means.

In the first and second examples, the surface of the photoreceptor is covered with the cover film at least in a range of from the development position to the transfer position B. Therefore cleaning means for cleaning the surface of the photoreceptor is not necessary. Conventional electrophotographic image forming apparatus typically use a contact cleaning device (such as cleaning blades) as the photoreceptor cleaning means. By using such a contact cleaning device, the surface of the photoreceptor is mechanically abraded, thereby shortening the life of the photoreceptor. Since the first and second examples do not use such a cleaning device, the surface of the photoreceptor is not abraded, resulting in prolongation of the life of the photoreceptor 10.

In order to further prolong the life of the photoreceptor 10, it is preferable to cover the portion of surface of the photoreceptor in the range of from the charging position, which is located on the upstream side from the development position, to the transfer position B. The reason therefore is as follows. In a charging process, the surface of the photoreceptor is slightly deteriorated (i.e., the surface becomes brittle) due to a discharging phenomenon caused between the charging device and the photoreceptor. Therefore, the surface of the photoreceptor can be easily abraded.

In contrast, when the charging process is performed on the surface of the photoreceptor with the cover film therebetween, the above-mentioned deterioration of the surface of the photoreceptor can be prevented.

When the surface of a photoreceptor is contacted with a cover film, there is a case where the photoreceptor is unevenly charged due to a discharging phenomenon caused between the photoreceptor and the cover film due to contact friction charging or charges, which are caused by separation of the cover film from the photoreceptor in the last transfer process and which still remain on the photoreceptor. Even in such a case, by performing charging on the photoreceptor with the cover film therebetween, the photoreceptor can be evenly charged because the uneven charges are cancelled.

In the first and second examples, the charging roller 8 is used as the charging means, and the cover film F is supplied so as to be tightly stretched by the charging roller. Therefore, the charging roller serves as the charging means and cover film stretching means, resulting in decrease of the number of parts of the image forming apparatus.

It is preferable that the surface of the cover film F is softer than that of the photoreceptor 10. In this case, occurrence of a problem in that the surface of the photoreceptor is abraded by the cover film, resulting in shortening of the life of the photoreceptor can be prevented. By supplying such a soft film to the charging position, not only the above-mentioned charging problem in that the surface of the photoreceptor is deteriorated due to a discharging phenomenon, but also the abrasion problem can be avoided, resulting in dramatic prolongation of the life of the photoreceptor. Namely, the photoreceptor can be used for a longer period of time than ever before.

When a film having surfaces with different hardnesses is used, it is preferable to contact the softer surface with the surface of the photoreceptor.

The present inventors made an experiment such that a polyvinyl chloride film having a thickness of 10 μm and a surface hardness (Rockwell hardness) of about 60 is used as the cover film F, a photoreceptor having an outermost layer made of a polycarbonate resin having a Rockwell hardness of about 80 is used as the photoreceptor 10, and the cover film and photoreceptor are contacted while moved for 100 hours at the same speed to determine whether the surface of the photoreceptor is abraded. As a result, it was confirmed that the surface of the photoreceptor is hardly abraded.

Next, a first modified example will be explained.

Figure 9:
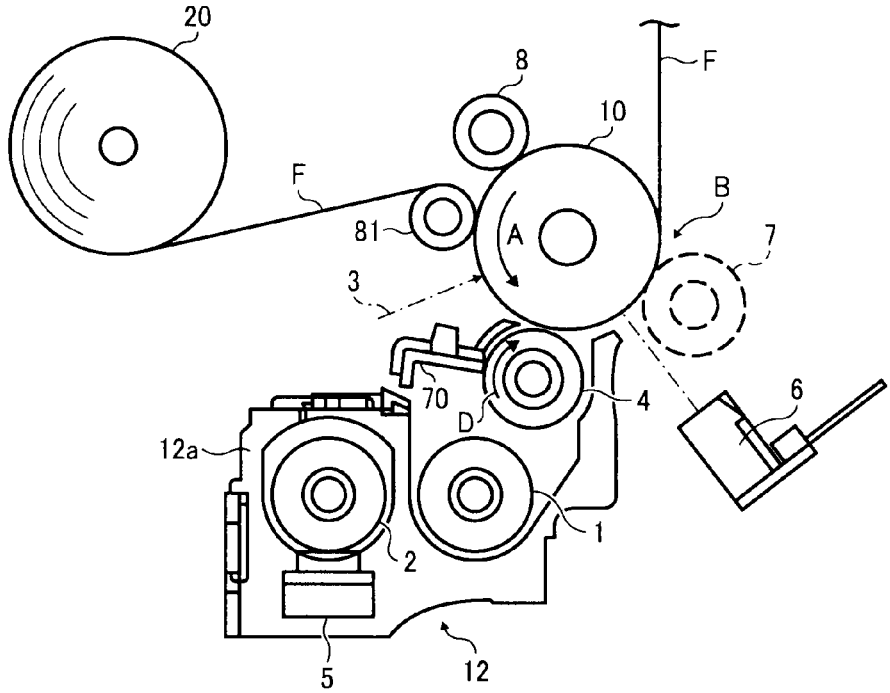
FIGS. 9-13 are schematic views illustrating the image forming sections of first to fifth modified examples of the first and second examples.

FIG. 9 is a view illustrating the image forming section of the first modified example, which includes the photoreceptor 10 and neighboring devices.

In the first and second examples, after the surface of the photoreceptor 10 is covered with the cover film F, the photoreceptor is charged with the charging roller 8, followed by light irradiating using the light beam 3, to form an electrostatic latent image on the photoreceptor. However, the order of the covering, charging and light irradiating processes is not limited thereto.

For example, as illustrated in FIG. 9, a cover film supplying roller 81 may be provided, independently of the charging roller 8, on a downstream side from the charging roller relative to the rotating direction A of the photoreceptor 10. In this modified example, the surface of the photoreceptor, which is not yet covered with the cover film, is charged with the charging roller 8, and then covered with the cover film, followed by light irradiating using the light beam 3 to form an electrostatic latent image on the surface of the photoreceptor. In this modified example, the position at which the cover film supplying roller 81 is opposed to the photoreceptor 10 is the cover film supplying position.

Similarly to the first example, clear images can be formed on the sheet S in this modified example. In the first modified example, the combination of the cover film F and the sheet S with a toner image therebetween is discharged from the apparatus (copier 500). However, similarly to the second example, the cover film may be collected using the cover film collecting device 101 while only the sheet S bearing a toner image thereon is discharged from the apparatus.

Next, a second modified example will be explained.

Figure 10:
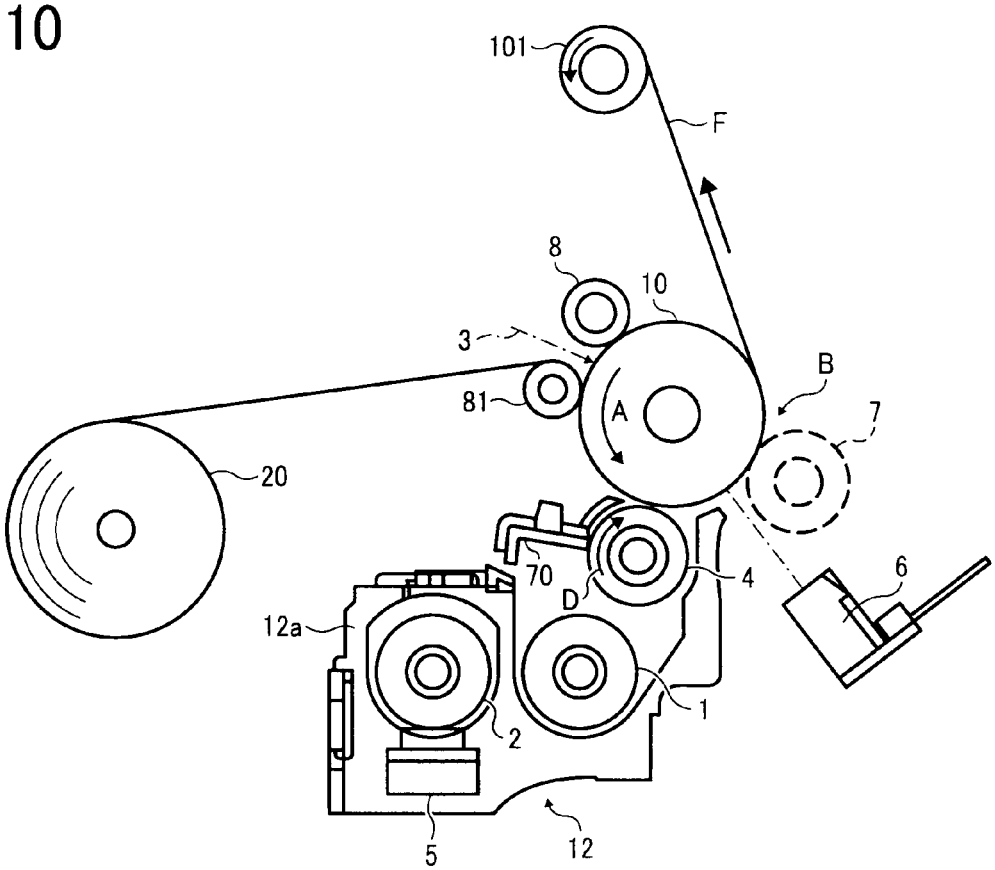

FIG. 10 is a view illustrating the image forming section of the second modified example, which includes the photoreceptor 10 and neighboring devices.

In the second modified example, as illustrated in FIG. 10, the cover film supplying roller 81 is arranged on a downstream side from the charging position (i.e., the nip between the charging roller 8 and the photoreceptor 10) and the light irradiation position relative to the rotating direction A of the photoreceptor 10. In this second modified example, after the surface of the photoreceptor 10 is charged and then exposed to the light beam 3 to form an electrostatic latent image, the surface is covered with the cover film F using the cover film supplying device 81 so that the electrostatic latent image is developed with the developing device 12 with the cover film therebetween. Thus, in this second modified example, the position at which the cover film supplying device 81 is opposed to the photoreceptor 10 is the cover film supplying position. In addition, the cover film F is collected by the cover film collecting device 101 after passing the transfer position B, and therefore only the sheet S bearing an image thereon is discharged from the apparatus.

In this second modified example, the light irradiating process is performed on the surface of the photoreceptor 10, which is not covered with the cover film F. Therefore, it is not necessary to use a transparent film as the cover film, i.e., a nontransparent film can also be used. Therefore, flexibility in choosing a cover film can be enhanced.

Next, a third modified example will be explained.

Figure 11:
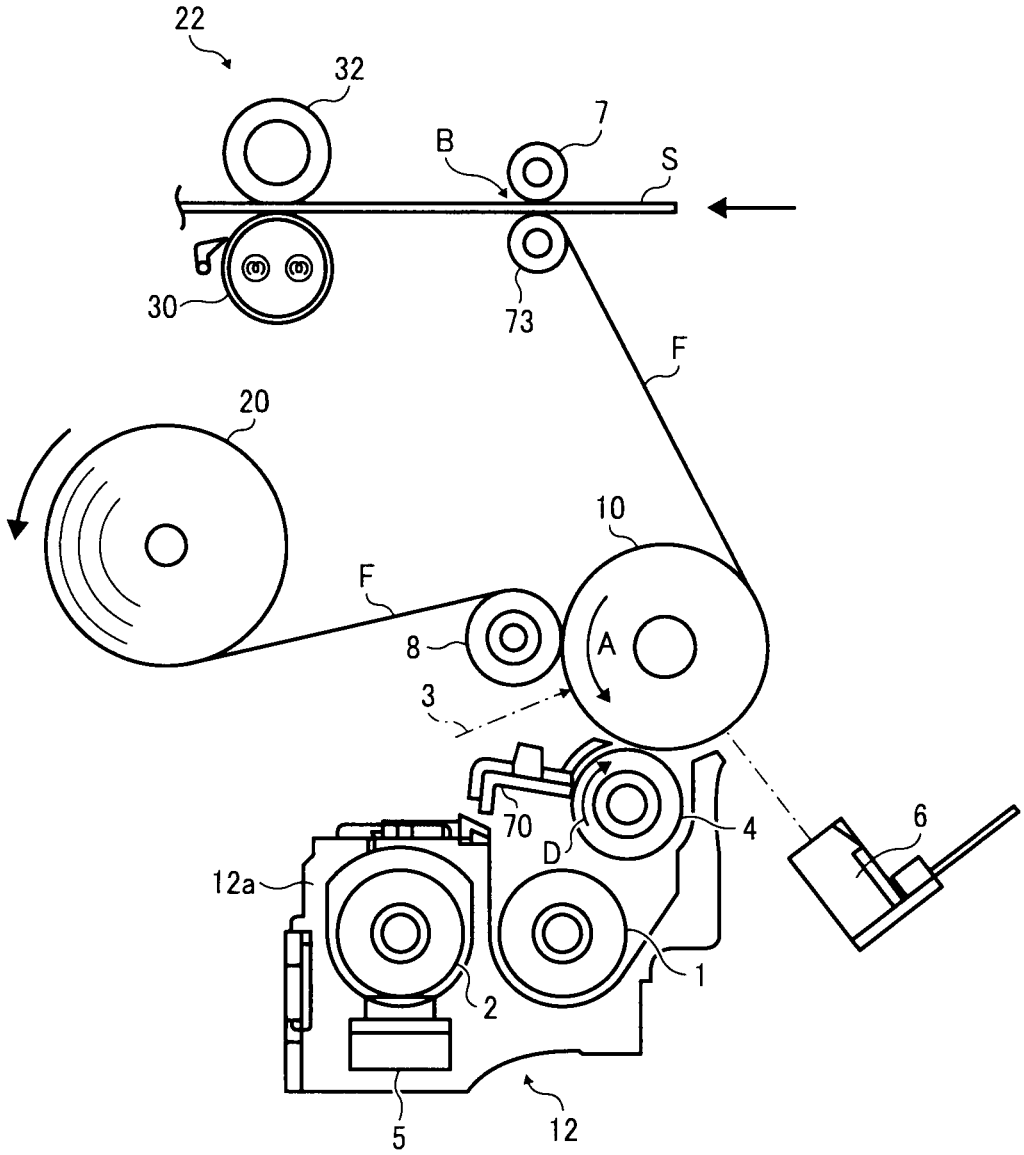

FIG. 11 is a view illustrating the image forming section of the third modified example, which includes the photoreceptor 10 and neighboring devices.

In the above-mentioned examples, the sheet S is opposed to the photoreceptor 10 with the cover film F therebetween at the transfer position B. However, the image transferring operation is not limited thereto. For example, in the third modified example, which is illustrated in FIG. 11, after the cover film F bearing a toner image thereon is separated from the photoreceptor 10, the cover film is contacted with the sheet S to transfer the toner image onto the sheet S.

Specifically, in the third modified example illustrated in FIG. 11, the transfer roller 7 arranged so as to be apart from the photoreceptor 10, and an opposed transfer roller 73 is provided so as to be opposed to the transfer roller. The cover film F is tightly stretched by the photoreceptor 10, the opposed transfer roller 73 and the fixation nip of the fixing device 22. Specifically, a toner image is formed on the cover film F at the development position, and the cover film bearing the toner image thereon is fed to the transfer position B so as to be contacted with the sheet S. The combination of the cover film and the sheet is fed to the fixing nip of the fixing device 22, resulting in fixation of the toner image on the sheet. Thus, a final image, which is a toner image fixed on the sheet S and covered with the cover film, is produced. In this example, it is not necessary to feed the sheet S to a position at which the sheet is opposed to the photoreceptor. Therefore, designing flexibility of the image forming apparatus can be enhanced.

In this third modified example, the cover film bearing a toner image is separated from the surface of the photoreceptor 10. When the cover film reaches the transfer position at which the sheet S is opposed to the cover film, the toner image is transferred onto the sheet S. In this example, the configuration such that the cover film is tightly stretched by the photoreceptor and the opposed transfer roller 73, the transfer roller 7 and the heat fixing device 22 serve as toner image transferring means for transferring a toner image onto the sheet S.

In this example, the cover film F is tightly stretched by the photoreceptor 10 and the opposed transfer roller 73, and thereby the cover film is separated from the surface of the photoreceptor. Therefore, the configuration such that the cover film is tightly stretched by the photoreceptor and the opposed transfer roller 73 constitutes cover film separating means.

In this third modified example, the combination of the cover film F and the sheet S is fed to the heat fixing device 22.

However, similarly to the second example, the cover film may be collected after transferring a toner image onto the sheet S.

Next, the fourth modified example will be explained.

Figure 12:
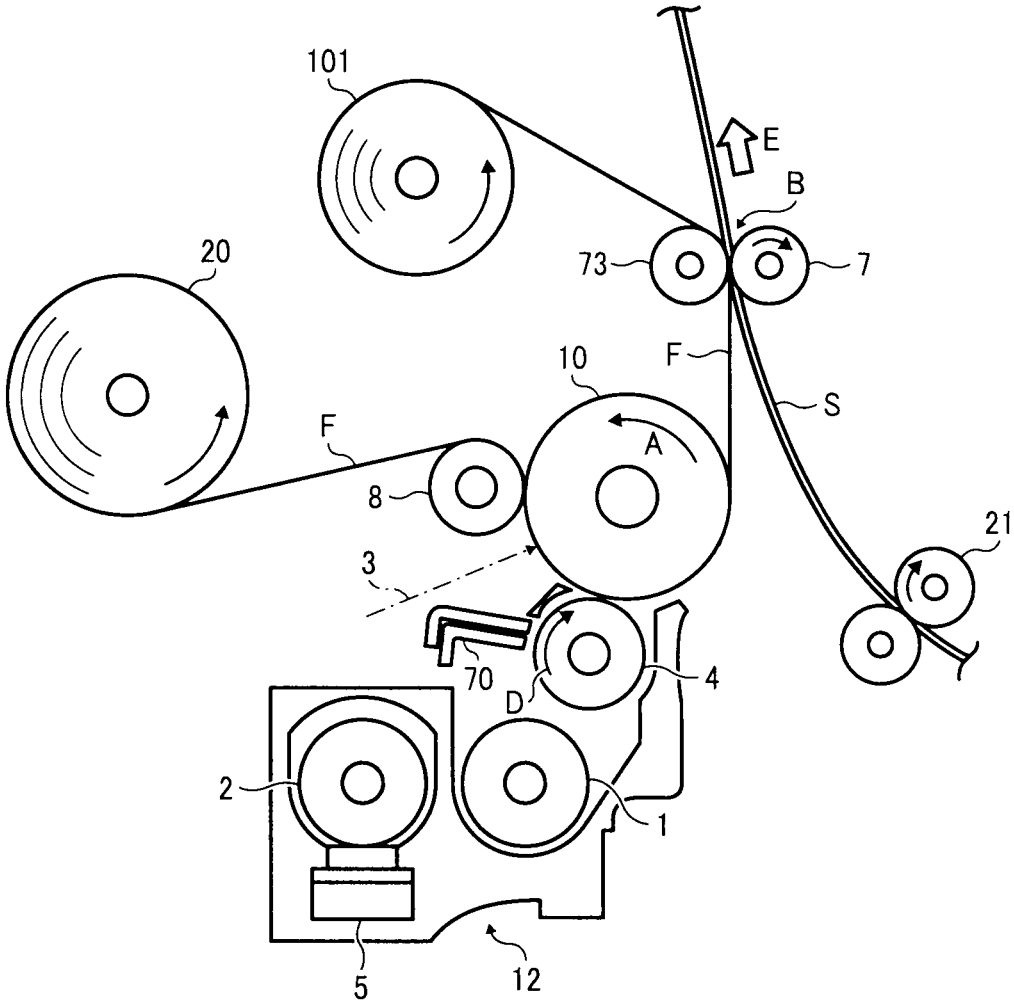

FIG. 12 is a view illustrating the image forming section of the fourth modified example, which includes the photoreceptor 10 and neighboring devices.

The configuration of the fourth modified example is substantially the same as that of the third modified example except that the cover film is collected with the cover film collecting device 101 after transferring a toner image onto the sheet S.

Specifically, as illustrated in FIG. 12, the transfer roller 7 is arranged so as to be apart from the photoreceptor 10, and the opposed transfer roller 73 is arranged so as to be opposed to the transfer roller 7, resulting in formation of the transfer nip (i.e., the transfer position B). In addition, the cover film collecting device 101 is provided to collect the cover film after the cover film passes the transfer position B. Thus, the cover film F is tightly stretched by the photoreceptor 10, the transfer roller 7 and the cover film collecting device 101. A transfer bias voltage is applied to the transfer roller 7 by a bias applying device (not shown), and therefore a transfer bias is formed between the transfer roller and the opposed transfer roller 73 at the transfer position B.

In this fourth modified example, the cover film F supplied from the cover film supplying device 20 is supplied to the surface of the photoreceptor 10 via the charging roller 8. The cover film is fed to a downstream side in the photoreceptor moving direction together with the photoreceptor while adhered to the photoreceptor due to the pressing force of the charging roller 8 and the charge formed on the photoreceptor by applying a charge bias thereto. In this case, the photoreceptor is charged by the charge bias. As the photoreceptor rotates, the cover film F is sequentially fed from the cover film supplying device. Next, the light beam 3 emitted by the laser writing device 47 irradiates the charged photoreceptor 10 to form an electrostatic latent image thereon. The electrostatic latent image is developed with the developing device 12 at the development position B, resulting in formation of a toner image on the cover film covering the surface of the photoreceptor 10.

Since the cover film F is tightly stretched by the photoreceptor 10 and the opposed transfer roller 73, the cover film bearing the toner image thereon is pulled by the opposed transfer roller 73, and thereby the cover film is moved to the transfer position B after separated from the surface of the photoreceptor. The pair of registration rollers 21 rotates to timely feed the sheet S to the transfer position B so that the toner image on the cover film F faces the sheet S at the transfer position. The cover film F is overlaid on the sheet S at the transfer nip (transfer position B) formed by the transfer roller 7 and the opposed transfer roller 73 or in the vicinity thereof, and thereby the toner image is transferred from the cover film F to the sheet S due to the transfer bias voltage applied to the transfer roller 7.

The cover film F passing the transfer position B is pulled by the cover film collecting device 101 in a direction different from the sheet feeding direction to be separated from the sheet. After passing the opposed transfer roller 73, the used cover film F is collected as a roll by the cover film collecting device 101. On the other hand, the sheet S bearing the toner image thereon is fed in a direction E so that the toner image is fixed by the heat fixing device 22. Thereafter, the sheet S is discharged on the stacking section 39.

Although the third modified example mentioned above has the cover film cutting device 90 for cutting the cover film so as to have the same size as the sheet S, the fourth modified example has no cover film cutting device because the cover film F is separated from the sheet S before the fixing operation, and collected by the cover film collecting device 101.

When the sheet S is contacted with the cover film F covering the surface of the photoreceptor 10 to transfer the toner image onto the sheet, a shock jitter problem in that the moving speed of the photoreceptor changes for a moment due to collision of the sheet with the photoreceptor, thereby forming jitter in the resultant image may be caused. Specifically, when the moving speed of the photoreceptor 10 is changed, the light beam 3 cannot irradiate the proper portion of the photoreceptor, resulting in formation of a defective electrostatic latent image on the photoreceptor.

In the third and fourth modified examples, the sheet S is contacted with the cover film F at a position apart from the photoreceptor 10, namely, the sheet does not collide with the photoreceptor. Therefore, the shock jitter problem is not caused in the third and fourth modified examples.

In addition, when the transfer roller 7 is contacted with the surface of the photoreceptor 10 with the cover film F therebetween at the transfer position B, a transfer bias voltage having a polarity opposite to that of the charge formed on the photoreceptor is applied by the transfer roller to the surface of the photoreceptor. Therefore, it is possible that the surface of the photoreceptor 10 is electrically damaged, resulting in shortening of the life of the photoreceptor.

In the third and fourth modified examples, the transfer roller 7 is arranged so as to be apart from the photoreceptor 10, and the toner image is transferred from the cover sheet onto the sheet S at a position apart from the photoreceptor. Therefore, electric damaging of the photoreceptor can be avoided, resulting in prolongation of the life of the photoreceptor.

In the fourth modified example, the configuration such that the cover film F is tightly stretched by the photoreceptor 10 and the opposed transfer roller 73, and the transfer roller 7 constitute toner image transfer means.

In addition, in the fourth modified example, since the cover film F is tightly stretched by the photoreceptor 10 and the opposed transfer roller 73, the cover film is separated from the surface of the photoreceptor. Therefore, the configuration such that the cover film F is tightly stretched by the photoreceptor 10 constitutes cover film separating means.

In order that the cover film F is rapidly separated from the surface of the photoreceptor 10, the diameter of the photoreceptor is as small as possible. Particularly in a case of curvature separation, the curvature of the photoreceptor is preferably not greater than 15 mm (i.e., the diameter of the photoreceptor is preferably not greater than 30 mm).

Next, a fifth modified example will be explained.

Figure 13:
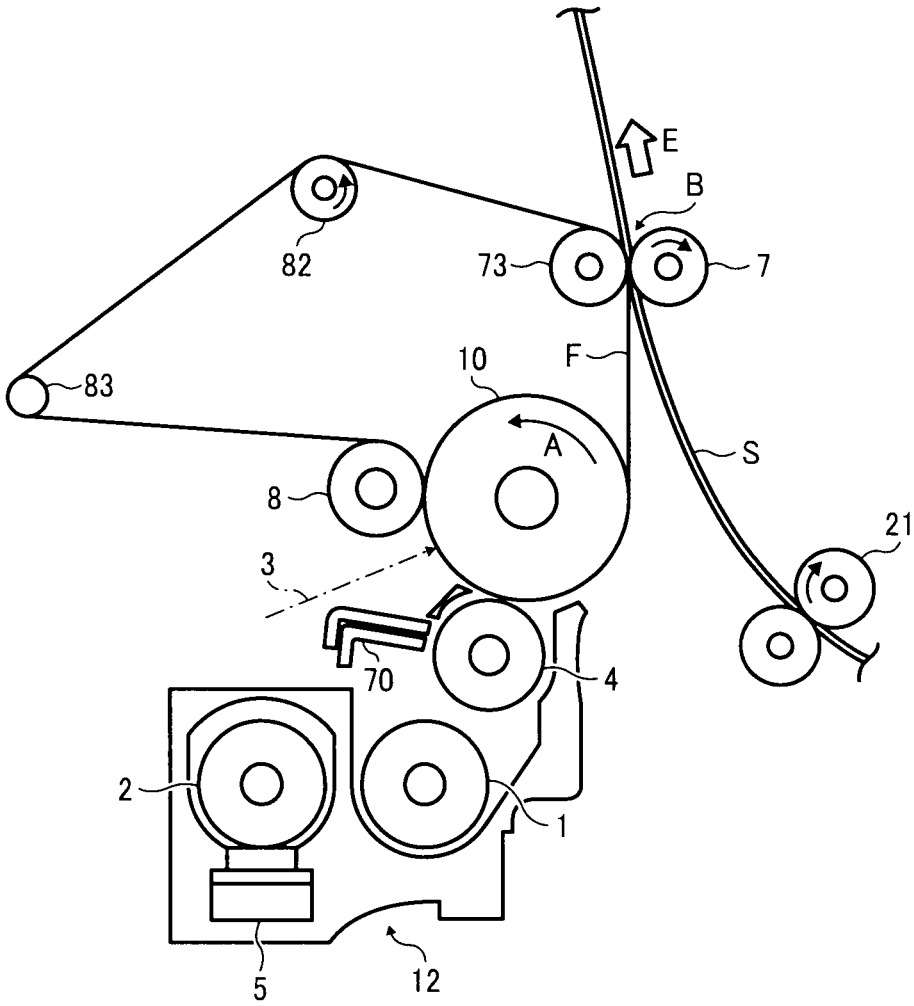

FIG. 13 is a view illustrating the image forming section of the fifth modified example, which includes the photoreceptor 10 and neighboring devices.

In the fourth modified example mentioned above, the cover film F bearing a toner image faces the sheet S at the transfer position B apart from the photoreceptor, and only the sheet is fed to the heat fixing device 22 after the toner image is transferred onto the sheet while the used cover film is collected by the cover film collecting device 101.

This fifth modified example is the same as the fourth example except that the cover film is an endless film, and the cover film collecting device 101 is not used.

The fifth modified example of the image forming apparatus of the present invention includes a first film stretching roller 82 and a second film stretching roller 83 to tightly stretch the endless cover film F with the first and second film stretching rollers, charging roller 8, photoreceptor 10, and opposed transfer roller 73.

Since the endless cover film F is repeatedly used, the running cost can be reduced. In addition, since the cover film supplying device 20, cover film cutting device 90 and cover film collecting device 101 are not necessary. Therefore, the image forming apparatus can be miniaturized and the cost thereof can be reduced. Further, the amount of used cover film can be decreased in this example, resulting in resource saving.

In this fifth modified example, the configuration such that the cover film F is tightly stretched by the photoreceptor 10 and the opposed transfer roller 73, and the transfer roller 7 constitute toner image transferring means for transferring a toner image on the photoreceptor (cover film) to the sheet S.

In addition, since the cover film F is tightly stretched by the photoreceptor 10 and the opposed transfer roller 73, the cover film is separated from the surface of the photoreceptor. Therefore, the configuration such that the cover film is tightly stretched by the photoreceptor 10 and the opposed transfer roller 73 constitutes cover film separating means.

Figure 14:
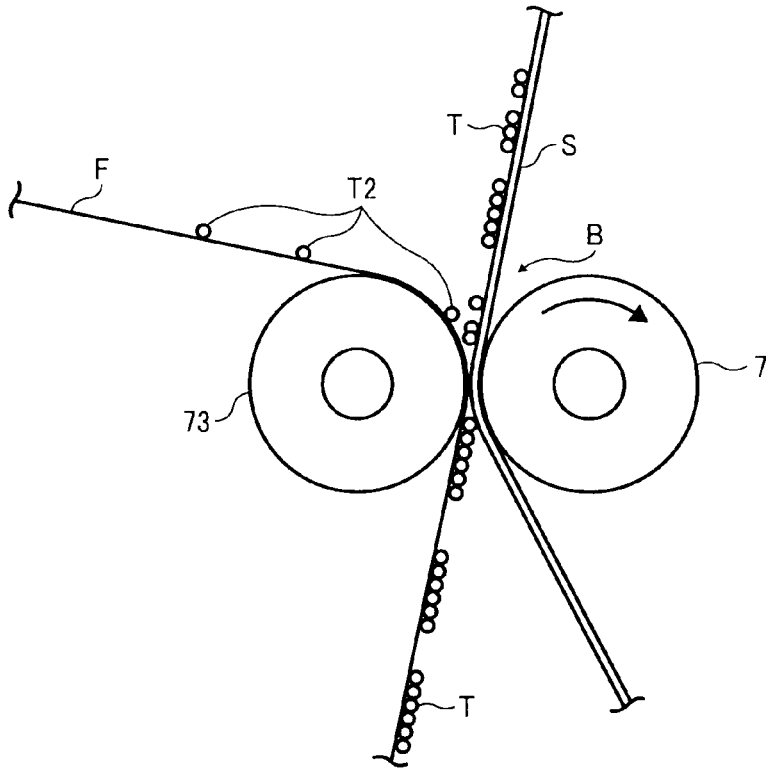
FIG. 14 is an enlarged view illustrating the transfer position of the fifth modified example.

FIG. 14 is an enlarged view illustrating the transfer position B of the fifth modified example and the vicinity thereof.

Referring to FIG. 14, when a toner image T is transferred from the cover film to the sheet S at the transfer position B, a residual toner particle T2 is present on the surface of the cover film after the image transfer process. When the residual toner particle T2 is present on the endless cover film F, the cover film F adversely affects the qualities of an image to be formed in the next image forming process by the image forming apparatus.

Therefore, when an endless cover film is used as the cover film like fifth modified example, it is preferable for the image forming apparatus to have a film cleaning device configured to clean the surface of the endless cover film. In this regard, any known cleaning devices having a cleaning member such as cleaning rollers and cleaning blades can be used for the endless cover film.

In the third to fifth modified examples mentioned above, the transfer position B is apart from the photoreceptor 10, and the photoreceptor is subjected to the charging, and electrostatic latent image writing processes after the surface of the photoreceptor is covered with the cover film F. However, in the image forming apparatus having configuration such that the transfer position is apart from the photoreceptor, the order of the covering, charging and electrostatic latent image writing processes is not limited thereto. For example, the surface of the photoreceptor may be covered with the cover film after the charging process, or after the charging and electrostatic latent image writing processes.

In the fourth and fifth modified examples, the cover film F is separated from the sheet S after the toner image thereon is transferred onto the sheet. However, the medium on which the toner image is transferred is not limited to sheets (such as the sheet S), and for example, other toner image bearing members such as intermediate transfer belts can also be used.

Next, a sixth modified example of the image forming apparatus of the present invention will be explained.

Figure 15:
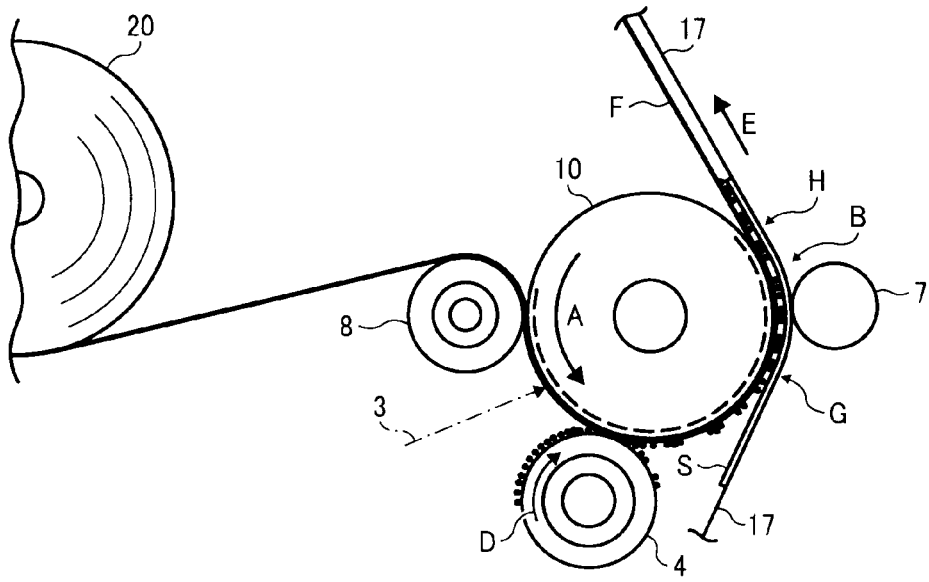
FIG. 15 is a schematic view illustrating the image forming section of a sixth modified example of the first and second examples.

FIG. 15 is an enlarged view illustrating the image forming section of the sixth modified example, which includes the photoreceptor 10 and neighboring devices.

In the sixth modified example, similarly to the first example, the cover film F and the sheet S are sandwiched by the photoreceptor 10 and transfer roller 7 so that the cover film is closely contacted with the sheet. In addition, a bias voltage having a polarity opposite to that of charge of the toner is applied to the transfer roller 7 to electrostatically adhere the sheet to the cover film, i.e., to unite the sheet with the cover film.

In the first example mentioned above, the position (i.e., a sheet contact starting position G illustrated in FIG. 15) at which the sheet S starts to be contacted with the cover film F is substantially the same as the transfer position B at which the transfer roller 7 is contacted with the photoreceptor 10 with the cover film and sheet therebetween.

In contrast, in this sixth modified example, the sheet contact starting position G is located on an upstream side from the transfer position B relative to the sheet feeding direction E. In this example, the cover film F can be contacted with the sheet S before the toner image on the cover film is influenced by the transfer bias.

When the sheet contact starting position G is substantially the same as the transfer position B, a background development problem in that the toner image on the cover film is influenced by the transfer bias before the sheet S is contacted with the cover film, and thereby the toner image is scattered from the surface of the cover film, resulting in formation of a defective toner image such as images with background development (i.e., images whose background portion is soiled with scattered toner particles) and scattered toner images may be caused. In contrast, in the sixth modified example where the sheet contact starting position G is located on an upstream side from the transfer position B, the combination of the sheet S and the cover film enters into the transfer position B, and thereby occurrence of the background development can be prevented. Therefore, high quality images can be produced.

In the sixth modified example, the heat fixing device 22 is provided on a downstream side from the transfer position B relative to the sheet feeding direction E, and the cover film cutting mechanism 90 is provided on a downstream side from the heat fixing device. The cover film F is continuous from the cover film supplying device 20 to the cover film cutting mechanism 90. Since the cover film F is tightly stretched by the fixing nip of the fixing device 22 and a sheet separation position H, the cover film is separated from the surface of the photoreceptor 10 together with the sheet S. Therefore, the configuration such that the cover film is tightly stretched by the fixing nip and the separation position of the photoreceptor constitutes cover film separating means.

In this sixth modified example, the combination of the cover film and the sheet passing the transfer position B and separated from the photoreceptor at the sheet separation position H is then fed to the fixing nip of the heat fixing device 22. The toner image is melted by the fixing device 22, and the combination of the cover film and the sheet with the toner image therebetween is discharged from the image forming apparatus.

The configuration such that the sheet contact starting position G is located on an upstream side from the transfer position B like the sixth modified example can be applied to an example having configuration such that cover film is separated from the sheet after transferring a toner image, and only the sheet S bearing a fixed toner image thereon is discharged as a copy sheet similarly to the second example.

In the sixth modified example, the sheet S is contacted with the cover film F at the sheet contact starting position G located on an upstream side from the sheet separation position H. The combination of the cover film F and the sheet S with the toner image therebetween is separated from the photoreceptor 10 at the sheet separation position H. Specifically, the configuration such that the cover film F is tightly stretched by the fixing nip and the photoreceptor 10 makes it possible that the sheet S is contacted with the cover film at the sheet contact starting position G which is located on a downstream side from the development position and an upstream side from the sheet separation position H, and the combination of the cover film and the sheet is separated from the surface of the photoreceptor at the separation position H. In the state where the sheet S is overlaid on the film F, the toner image on the cover film is sandwiched by the cover film and the sheet, and therefore toner scattering caused by discharging phenomenon and impact of the sheet is hardly caused, thereby hardly forming defective toner images such as scattered toner images and images with background development. Therefore, in this example, even when delamination discharging due to separation of the cover film from the photoreceptor is caused, occurrence of the toner scattering problem is prevented and deterioration of image qualities due to toner scattering can be prevented.

In this example, the sheet S is fed to the sheet contact starting position G while supported by the transfer belt 17 to reduce the chance of occurrence of a problem in that the sheet is displaced or flip-flops due to collision of the sheet with the cover film and the photoreceptor.

In order to enhance adhesion of the sheet S to the cover film F, a pre-transfer pressing member may be provided on an upstream side from the transfer position B.

Figure 16:
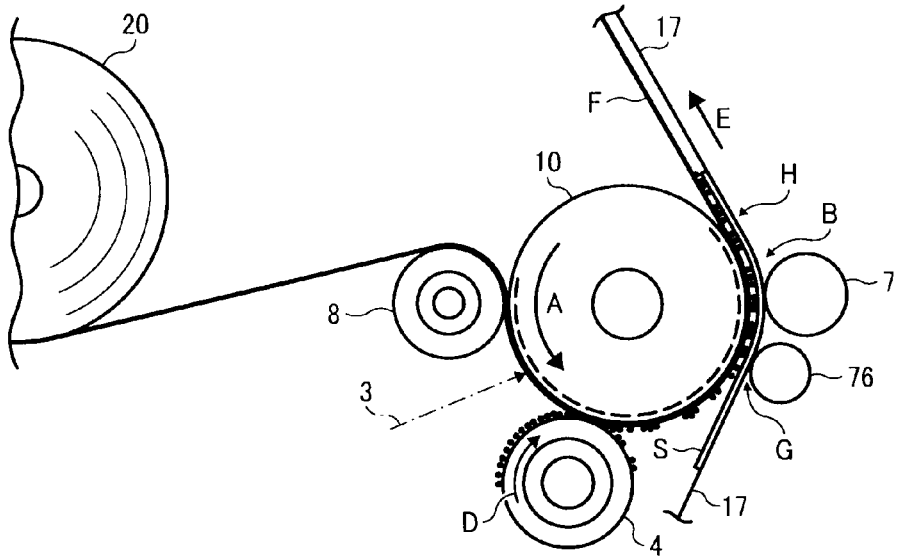
FIG. 16 is a schematic view illustrating the image forming section of a modified version of the sixth example further including a pressing member.

FIG. 16 illustrates of a modified version of the sixth modified example in which a pre-transfer pressing roller 76 is provided as the pre-transfer pressing member. The pre-transfer pressure roller 76 is pressed to the photoreceptor 10 by a pressing mechanism (not shown). By providing such a pre-transfer pressing member, the chance of toner scattering due to discharging phenomenon occurring in a space formed between the sheet S and the cover film F can be further reduced, thereby preventing deterioration of image qualities due to toner scattering.

Elastic rubber rollers such that an elastic layer made of a rubber or the like is formed on a metal roller are preferably used for the pre-transfer pressure roller 76. In this regard, in order to prevent occurrence of a problem in that image qualities are deteriorated due to charge-up of the pre-transfer pressing roller 76 caused by frictional charging, it is preferable to add an ion-conducting material or an electroconductive material (such as carbon black) to the elastic layer to control the resistance of the layer. The pre-transfer pressing member is not limited to such a pressure roller, and a pressing member such that a plate-form rubber is in pressing-contact with the transfer belt 17 can also be used.

In this sixth modified example, the transfer roller 7 applies a transfer bias voltage to the cover film F and sheet S to electrostatically adhere the sheet to the cover film. Next, the combination of the sheet to the cover film is separated from the surface of the photoreceptor. In this case, even when delamination discharging due to separation of the cover film from the photoreceptor is caused, occurrence of the toner scattering problem can be prevented because the space between the cover film and the sheet is very narrow, and thereby clear images can be produced.

Next, a seventh modified example will be explained.

Figure 17:
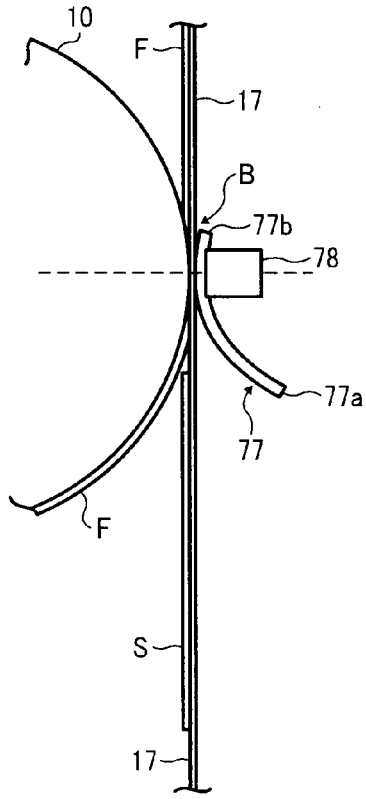
FIG. 17 is a schematic view illustrating the image forming section of a seventh modified example of the first and second examples.

FIG. 17 is an enlarged view illustrating the image forming section of the seventh modified example, which includes the photoreceptor 10 and neighboring devices.

In the above-mentioned two examples and six modified examples, the transferring device 13 is a device having a transfer roller to which a transfer bias is applied by a bias application device (not shown). However, the transfer device is not limited thereto, and may be a device having a sheet-form transfer member such as a sheet-form transfer member 77 illustrated in FIG. 17.

In this seventh modified example illustrated in FIG. 17, the sheet-form transfer member 77 has a fixed end 77*a* located on an upstream side from the transfer position B, at which the transfer member 77 is closest to the photoreceptor 10, relative to the sheet feeding direction, and a free end 77*b* on a downstream side. In addition, the transfer device includes a sheet pressing member 78 configured to press the transfer member 77 toward the photoreceptor 10.

At the transfer position B, the transfer member 77 is contacted with the photoreceptor 10 with the transfer belt 17 and the cover film F therebetween. Therefore, this transfer device has simpler structure and lower costs than transfer devices having a transfer roller.

This transfer device having the transfer member 77 can be applied to the above-mentioned two examples and six modified examples.

In this example using the transfer member 77, the sheet S is fed to the transfer position B by the transfer belt 17, the chance of occurrence of the image deterioration problem caused by impact of the sheet S with the cover film F can be reduced.

In addition, the transferring device using the transfer member 77 can have such a pre-transfer pressing member as illustrated in FIG. 16 to narrow the gap between the cover film F and the sheet S, i.e., to reduce the chance of occurrence of the image deterioration problem.

The sheet pressing member 78 is made of an elastic material such as sponges to press the transfer member 77 toward the photoreceptor 10 using the elastic force thereof. Therefore, the transfer device has a relatively simple structure, and the costs of the transfer device can be further reduced.

Next, a third example will be explained.

In the first example, the sheet S is discharged from the image forming apparatus (i.e., copier 500) together with the cover film F, and the between-paper portion of the cover film present between two sheets is cut and discharged on the stacking section 39 (as illustrated in FIG. 2) or the film piece container 80 (as illustrated in FIG. 5 or 6). The between-paper portion of the cover film F is then disposed of. Therefore, in view of material saving and cost reduction, the amount of the cover film thus disposed of is as small as possible.

In this third example, the sheet S covered with the cover film F is discharged similarly to the first example, but the amount of the cover film disposed of is decreased.

Figure 18:
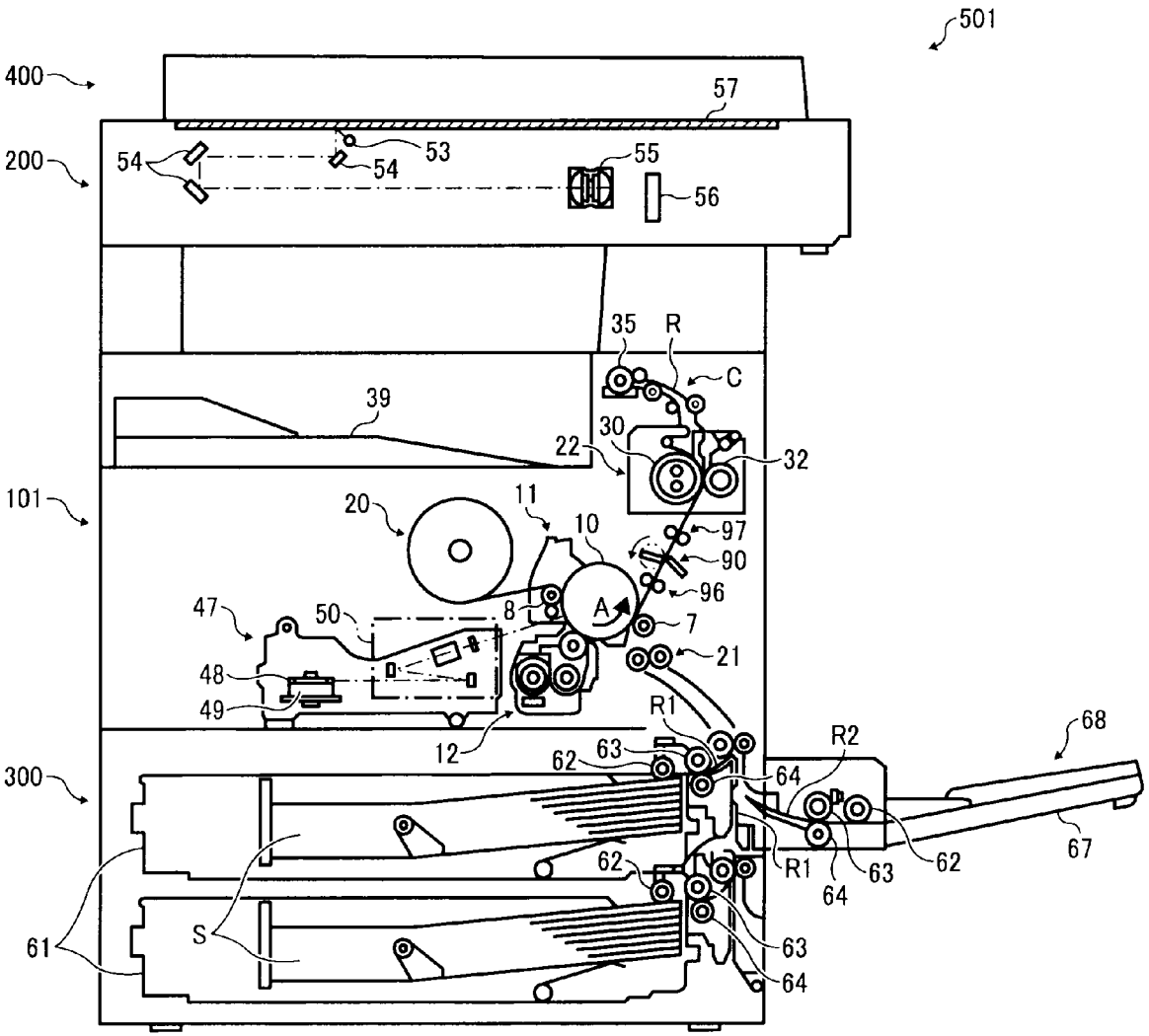
FIG. 18 is a schematic view illustrating the entire of a third example of the image forming apparatus of the present invention.

FIG. 18 illustrates the third example of the image forming apparatus of the present invention.

Referring to FIG. 18, a copier 501 is the same as the copier 500 except that the cover film cutting mechanism 90 is provided on an upstream side from the heat fixing device 22 relative to the sheet feeding direction. Hereinafter, the different point will be mainly explained.

In this third example, the tip of the cover film F, which has a roll-form and which is set in the cover film supplying device 20, is sandwiched by the charging roller 8 and the photoreceptor 10 before starting an image forming operation. When an image forming operation is performed, the photoreceptor 10 and the rotation shaft on which the roll-form cover film is set are rotated counterclockwise, and thereby the tip of the cover film is fed toward the downstream side relative to the rotation direction of the photoreceptor. In this case, pairs of feed rollers 96 and 97 arranged on both sides of the cover film cutting mechanism 90 are rotated to apply a feeding force in the direction of the fixing device 22 to the cover film.

The photoreceptor 10 is timely subjected to the charging and light irradiation processes so that the position of tip of the electrostatic latent image formed on the photoreceptor is identical to the position of tip of the cover film F, and then the electrostatic latent image is developed to form a toner image on the cover film covering the photoreceptor.

The pair of registration rollers 21 is timely rotated to feed the sheet S toward the photoreceptor 10 such that the sheet faces the cover film F bearing the toner image at the transfer position at which the transfer roller 7 faces the photoreceptor 10. After the thus fed sheet S is overlaid on the cover film F with the toner image therebetween, the combination of the sheet and the cover film is separated from the photoreceptor 10. Thus, a toner image is formed on the sheet S while covered with the transparent cover film F.

At the transfer position, the cover film F is electrostatically adhered to the sheet S due to the transfer bias applied to the transfer roller 7, and the combination of the cover film and the sheet is separated from the photoreceptor using a separating member such as separation picks or utilizing the stiffness of the sheet itself. Thus, the configuration such that the combination of the sheet and cover film is separated from the photoreceptor constitutes cover film separating means.

Similarly to the first example, the cover film F is adhered to the sheet S by an electrostatic force. In this regard, an adhesive may be applied onto the surface of the cover film facing the sheet S or the surface of the sheet S facing the cover film so that the cover film is securely adhered to the surface of the sheet S. In addition, by using a toner having a high adhesiveness, the cover film can be securely adhered to the surface of the sheet S by the adhesive force.

The sheet S, which has been combined with the cover film F at the transfer position, is then fed to the cover film cutting mechanism 90. When the rear edge of the sheet S reaches the cutting position of the cutting mechanism, a controller (not shown) of the copier stops the feeding operations of the feeding members for applying a feeding force to the sheet and cover film. Specifically, rotation of the pairs of feed rollers 96 and 97 arranged on both sides of the cutting mechanism 90, the photoreceptor 10, and the rotation shaft of the cover film supplying device 20 is stopped.

The controller orders the cover film cutting mechanism 90 to cut the cover film such that the cutting line is identical to the rear edge of the sheet S while stopping rotation of the feeding members. After the cutting mechanism 90 cuts the cover film F, the controller rotates the pair of rollers 97 on the downstream side from the cutting mechanism 90 to feed the combination of the sheet and the cover film to the fixing device 22. After passing the heat fixing device 22, the combination of the sheet and the cover film is discharged on the stacking section 39 by the discharging roller 35. Thus, a copy in which the entire surface of the sheet S is covered with the cover film F with the fixed toner image therebetween is obtained.

On the other hand, when the cutting mechanism 90 cuts the cover film F, the controller drives the pair of feed rollers 96 located on the upstream side from the cutting mechanism 90, the photoreceptor 10, the rotation shaft of the cover film supplying device 20 to rotate in the opposite direction to feed the cover film in the opposite direction so that the cover film F is wound on the cover film roll. The controller stops the feeding members when the tip (cut line) of the cover film F is returned to the nip between the charging roller 8 and the photoreceptor 10. Thus, the cover film F returns the starting position.

Similarly to the above-mentioned image forming operation, the next image forming operation is performed starting from counterclockwise rotating the photoreceptor 10 and the rotation shaft, on which the cover film roll is set, to feed the cover film toward the downstream side relative to the rotation direction of the photoreceptor.

Since the third example has the above-mentioned configuration, the cover film can be used without producing waste thereof, resulting in cost reduction and material saving. In addition, since the diameter of the roll-form cover film can be decreased, the image forming apparatus can be miniaturized.

The position of the cover film cutting mechanism 90 is not limited to the upstream position from the fixing device 22, and the cutting mechanism may be arranged on a downstream side from the fixing device. In this case, when the cover film F is cut and then returned to the starting position, the front portion of the cover film F is returned to the starting position after passing the heat fixing device 22. Therefore, it is necessary for the cover film not to be deteriorated at the fixing temperature, so that the developing process can be well performed on the heated cover film in the next image forming operation. In addition, since the photoreceptor is contacted with the front portion of the cover film, which has been heated by the heat fixing device when returned to the starting position, it is likely that the photoreceptor is deteriorated by the heat applied by the cover film, resulting in shortening of the life of the photoreceptor.

In contrast, in the third example (i.e., the copier 501) illustrated in FIG. 18, the front portion of the cover film returned to the starting position is not heated by the heat fixing device 22. Therefore, films, which are deteriorated when heated by the fixing device, can also be used as the cover film. In addition, films whose adhesiveness to the sheet S is increased when heated by the fixing device can be used as the cover film. Further, since the front portion of the cover film returned to the starting position is not heated by the heat fixing device 22, the photoreceptor is not deteriorated when contacted with the front portion of the cover film. Namely, the front portion of the cover film can be used like a brand new cover film.

Whether the cover film cutting mechanism 90 is located on the upstream or downstream side from the fixing device 22, the cut front portion of the cover film is returned to the starting position by rotating the feeding members such as the photoreceptor 10 so that the front portion, which becomes free when being cut by the cutting mechanism, is contacted with the photoreceptor. Therefore, the next image forming operation can be performed on the photoreceptor through the cover film.

Figure 19:
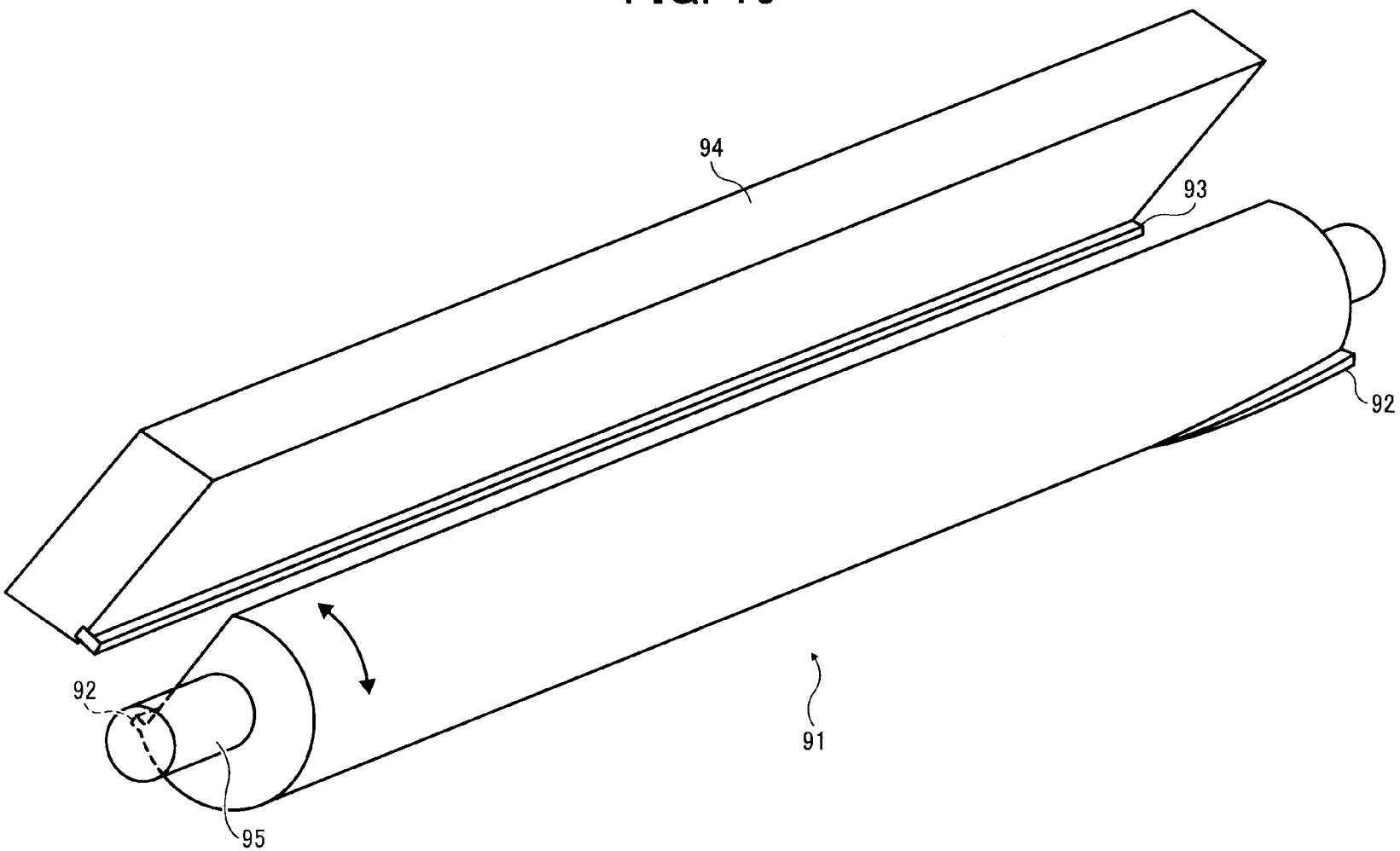
FIG. 19 is a schematic view illustrating a rotary cutter for use in the image forming apparatus of the present invention.

A rotary cutter 91 illustrated in FIG. 19 can be preferably used for the cover film cutting mechanism 90. Referring to FIG. 19, the rotary cutter 91 include a rotatable shaft 95 having a rotatable blade 92, a fixed blade 93 arranged so as to be opposed to the rotatable blade, and a holder 94 bearing the fixed blade 93 thereon. By rotating the rotatable blade 92 so as to be opposed to the fixed blade 93 with the cover film therebetween, the cover film can be cut.

The rotary cutter 91 can be used for the cover film cutting mechanism 90 illustrated in FIGS. 2 and 6 as well as the cover film cutting mechanism 90 illustrated in FIG. 19.

The cover film cutting mechanism 90 is not limited to such a rotary cutter, and any cutters which can cut a cover film in a direction perpendicular to the feeding direction of the cover film. When using the rotary cutter 91, the cutting position is the edge of the fixed blade 93.

[Experiment 6]

In this experiment, an image forming apparatus, IMAGIO MP 5000 from Ricoh Co., Ltd., is used as the image forming apparatus, and a polyvinylidene chloride (PVDC) film (KREWRAP from Kureha Corp.) having a thickness of 10 μm is used as the cover film.

The image forming apparatus was modified such that the rotary cutter 90 is provided on an upstream side from the heat fixing device 22, and two pairs of feed rollers 96 and 97 are arranged on both sides of the rotary cutter 90 as illustrated in FIG. 18. The cover film (PVDC film) was wound around the photoreceptor 10 so that the cover film takes the starting position. In addition, sheets of a paper with A-4 size serving as the sheet S were set on the sheet cassette 61 in such a manner that the longitudinal direction of the paper sheets is perpendicular to the paper feeding direction, and a copying operation was performed. As a result, a copy in which an image is formed on one of the paper sheets while covered with the cover film was stacked on the stacking section 39. The image was clear and had no problem.

[Experiment 7]

In this experiment, an image forming apparatus, IMAGIO MP 5000 from Ricoh Co., Ltd., is used as the image forming apparatus, and a polyvinylidene chloride (PVDC) film (KRE-WRAP from Kureha Corp.) having a thickness of 10 μm is used as the cover film.

The image forming apparatus was modified such that the cover film cutting mechanism 90 having a rotary cutter is provided on a downstream side from the heat fixing device 22 as illustrated in FIG. 2, and two pairs of feed rollers 96 and 97 are arranged on both sides of the rotary cutter 90. The cover film (PVDC film) was wound around the photoreceptor 10 so that the cover film takes the starting position. In addition, sheets of a paper with A-4 size serving as the sheet S were set on the sheet cassette 61 in such a manner that the longitudinal direction of the paper sheets is perpendicular to the paper feeding direction, and a copying operation was performed. As a result, a copy in which an image is formed on one of the paper sheets while covered with the cover film was stacked on the stacking section 39. The image was clear and had no problem.

[Experiment 8]

The procedure for production of a copy in Experiment 6 was repeated except that the cover film was changed to a polyvinyl chloride (PVC) film (RIKEN WRAP from Riken Technos Corp.) having a thickness of 10 μm. As a result, a copy in which an image is formed on one of the paper sheets while covered with the cover film was stacked on the stacking section 39 similarly to Experiment 6. The image was clear and had no problem.

In the third example, the entire surface of a fixed image is covered with the cover film F, and therefore the image has good texture and high glossiness. In addition, since the cover film is cut after the transfer position, the surface of the photoreceptor 10 is covered with the cover film F at the charging, light irradiation, and development positions. Therefore, the life of the photoreceptor 10 can be prolonged, i.e., high quality images can be stably produced for a long period of time.

Next, a fourth example of the image forming apparatus will be explained.

In the first and third examples, the sheet S serving as a receiving material is discharged while covered with the cover film F. The cover film F is cut at the rear edge of the sheet S after the cover film is overlaid on the sheet. However, the cutting position is not limited thereto, and the cover film may be cut on an upstream side from the contact point of the cover film with the surface of the photoreceptor 10.

In this fourth example, the photoreceptor is covered with the cover film at least at the development position, the sheet is discharged from the apparatus while covered with the cover film, and the cover film is cut on an upstream side from the contact point of the cover film with the surface of the photoreceptor 10.

Figure 20:
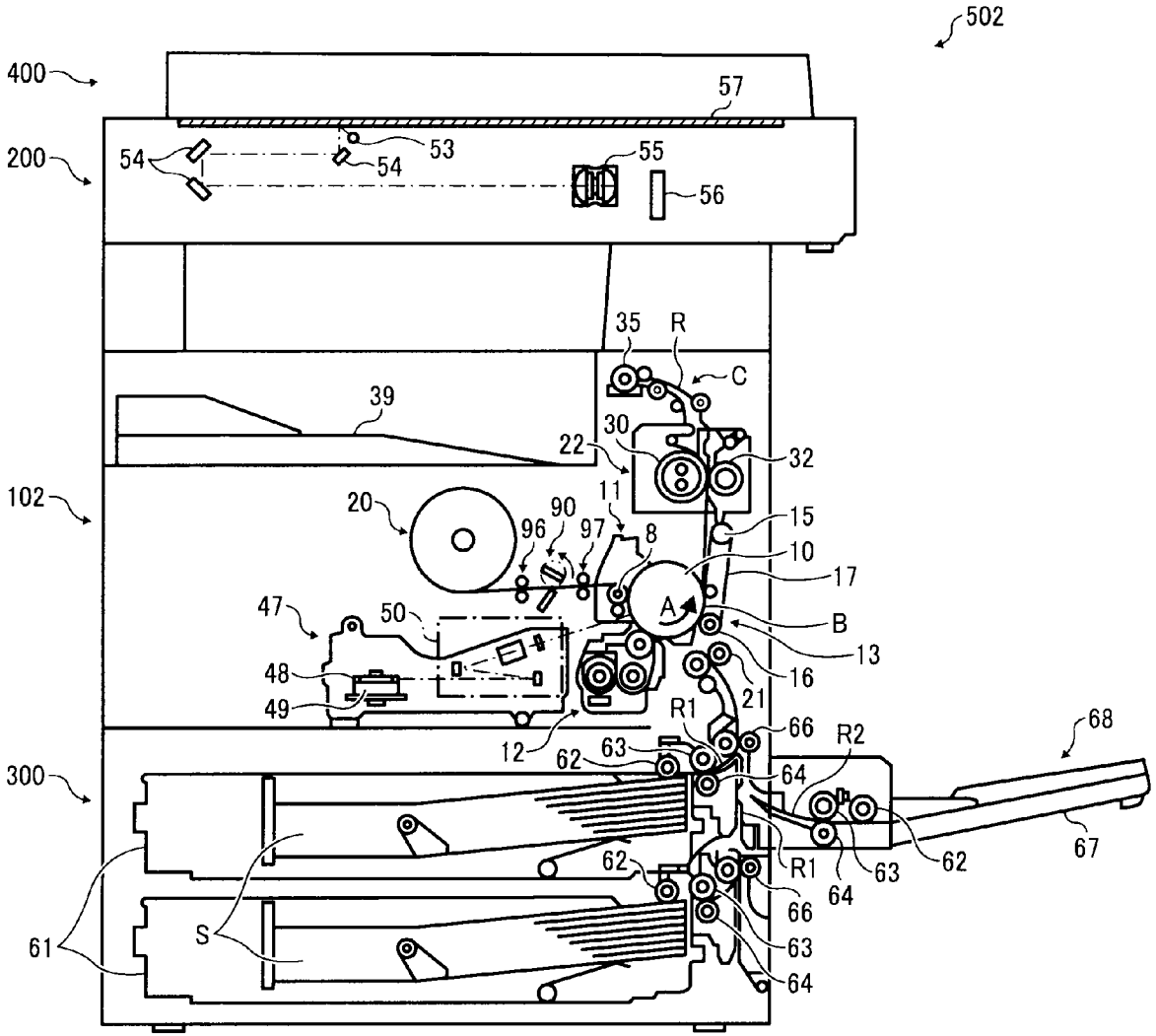
FIGS. 20-21 are schematic views illustrating a fourth example of the image forming apparatus of the present invention.
Figure 21:
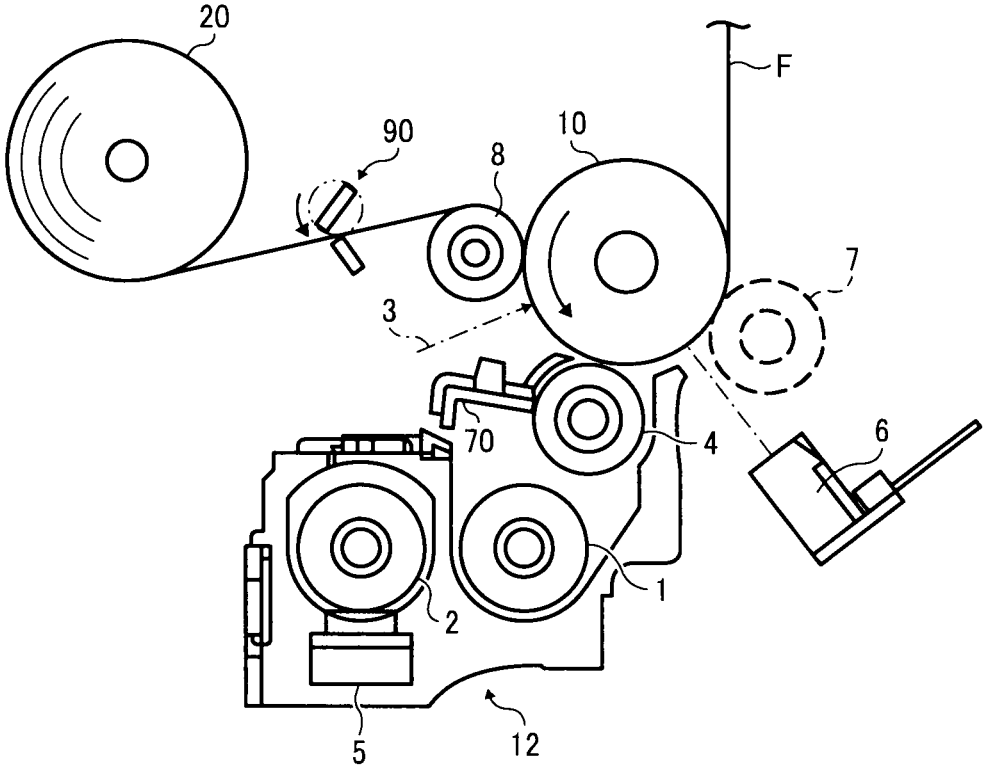

FIG. 20 illustrates the entire of the fourth example (copier) of the image forming apparatus of the present invention, and FIG. 21 illustrates the image forming section thereof including the photoreceptor and neighboring devices.

A copier 502 illustrated in FIG. 20 is the same as the copier 500 illustrated in FIG. 2 except that the film cutting mechanism 90 is arranged between the cover film supplying device 20 and the charging roller 8 at which the cover film F is contacted with the surface of the photoreceptor 10. Therefore, the different point will be mainly explained.

In the copier 502, the cover film supplying device 20 supplies the cover film F from a cover film roll to the surface of the photoreceptor 10 to cover the surface with the cover film. The cover film cutting mechanism 90 cuts the cover film F in the direction perpendicular to the feeding direction of the cover film. Known cutters, which can cut a film in the direction perpendicular to the feeding direction of the film, such as the rotary cutter 91 illustrated in FIG. 19 can be used for the cover film cutting mechanism 90. In addition, the copier 502 includes the two pairs of feed rollers 96 and 97 on both sides of the cutting mechanism 90.

The cover film cutting mechanism 90 cuts the cover film fed from the cover film supplying device 20 such that the cut cover film has the same length as the sheet S fed from the sheet bank 300. The cut cover film is fed to the contact position of the charging roller with the photoreceptor by the pair of feed rollers 97 arranged on a downstream side from the cutting device 90. The cut cover film is fed to the downstream side relative to the rotation direction of the photoreceptor while adhered to the surface of the photoreceptor due to the pressing force of the charging roller 8 and the charge bias applied to the charging roller to charge the photoreceptor. In this case, the photoreceptor is charged.

After the cover film is cut by the cutting mechanism 90, the rotation shaft, on which the cover film roll is set, and the pair of feed rollers 96 are not rotated, and thereby the cover film is not fed until the next image forming operation.

On the other hand, the surface of the photoreceptor covered with the cover film is subjected to the charging process, the light irradiating process, and the developing process, thereby forming a toner image on the surface of the cover film.

The pair of registration rollers 21 is timely rotated to feed the sheet S toward the transfer position B such that the position of tip of the cover film is identical to the position of tip of the sheet at the transfer position.

The combination of the sheet and the cover film with the toner image therebetween is then separated from the surface of the photoreceptor using a separating member such as separation pick or utilizing the stiffness of the sheet itself. In this regard, the cover film F is electrostatically adhered to the sheet S due to the charges formed by applying a transfer bias. Thus, an image is formed on the sheet while covered with the cover film. The configuration such that the cover film passing the transfer position B is separated from the photoreceptor together with the sheet S constitutes the cover film separating means.

In this regard, the cover film F is adhered to the sheet S by an electrostatic force therebetween. However, an adhesive may be applied onto the surface of the cover film facing the sheet S or the surface of the sheet S facing the cover film so that the cover film is securely adhered to the surface of the sheet S. In addition, by using a toner having a high adhesiveness, the cover film can be securely adhered to the surface of the sheet S by the adhesive force.

The combination of the cover film and the sheet with the toner image therebetween is then guided to the fixing nip formed by the heat roller 30 and pressure roller 32 of the heat fixing device 22, and thereby the toner image is fixed to the sheet S while covered with the cover film F. The thus prepared copy is discharged on the stacking section 39 by the discharging roller 35.

[Experiment 9]

In this experiment, an image forming apparatus, IMAGIO MP 5000 from Ricoh Co., Ltd., is used as the image forming apparatus, and a polyvinylidene chloride (PVDC) film (KRE-WRAP from Kureha Corp.) having a thickness of 10 μm is used as the cover film.

The image forming apparatus was modified such that as illustrated in FIG. 20, the cover film cutting device 90 including a rotary cutter 91 and the two pairs of feed rollers 96 and 97 arranged on both sides of the rotary cutter is provided on an upstream side from the charging roller 8. The cover film (PVDC film) was wound around the photoreceptor 10 so that the cover film takes the starting position. In addition, sheets of a paper with A-4 size serving as the sheet S were set on the sheet cassette 61 in such a manner that the longitudinal direction of the paper sheets is perpendicular to the paper feeding direction, and a copying operation was performed while the number of rotation of the rotary cutter is adjusted such that the cover film is cut so as to have the same length as the sheet S. As a result, a copy in which an image is formed on one of the paper sheets while covered with the cover film was stacked on the stacking section 39. The image was clear and had no problem.

[Experiment 10]

The procedure for production of a copy in Experiment 9 was repeated except that the cover film was changed to a polyvinyl chloride (PVC) film (RIKEN WRAP from Riken Technos Corp.) having a thickness of 10 μm. As a result, a copy in which an image is formed on one of the paper sheets while covered with the cover film was stacked on the stacking section 39 similarly to Experiment 9. The image was clear and had no problem.

Next, a fifth example of the image forming apparatus of the present invention will be explained.

Figure 22:
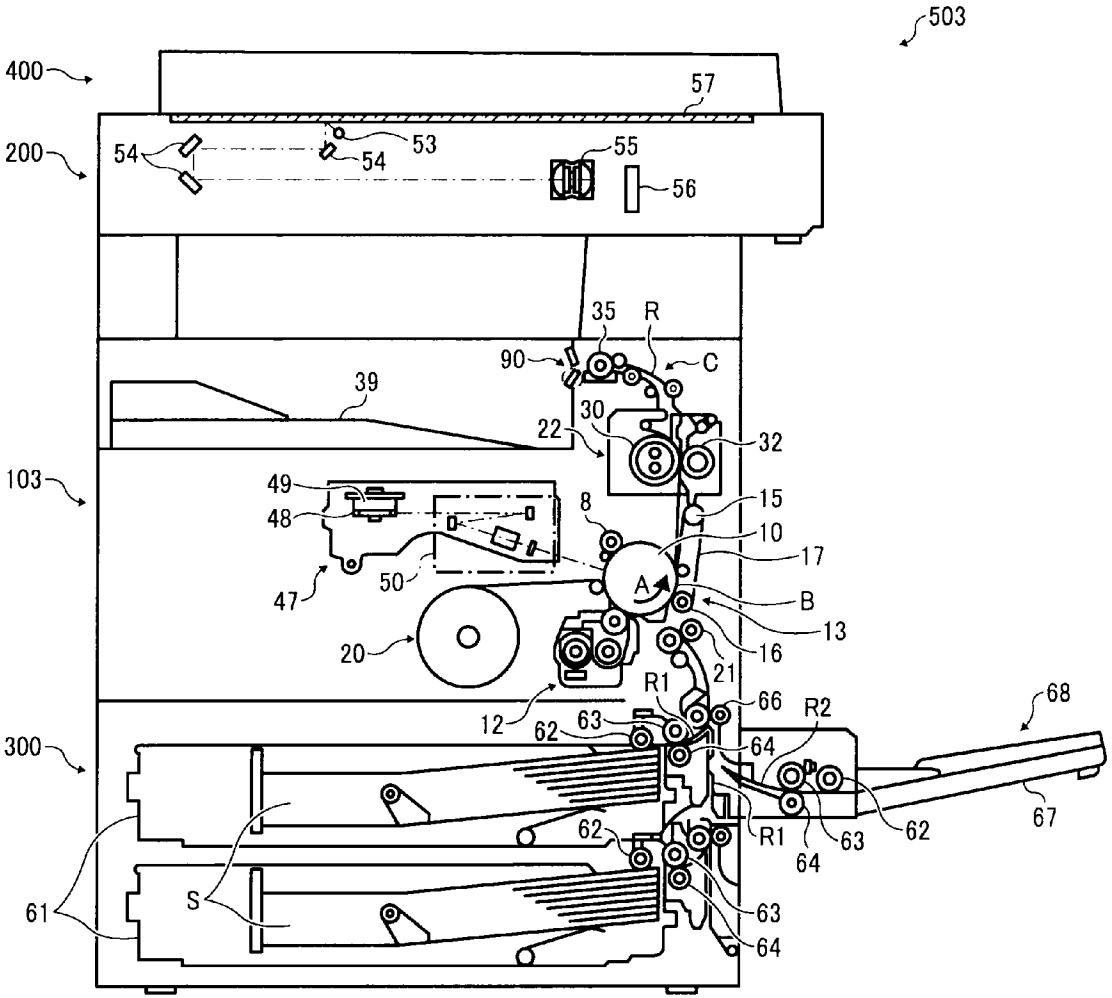
FIGS. 22-23 are schematic views illustrating a fifth example of the image forming apparatus of the present invention.
Figure 23:
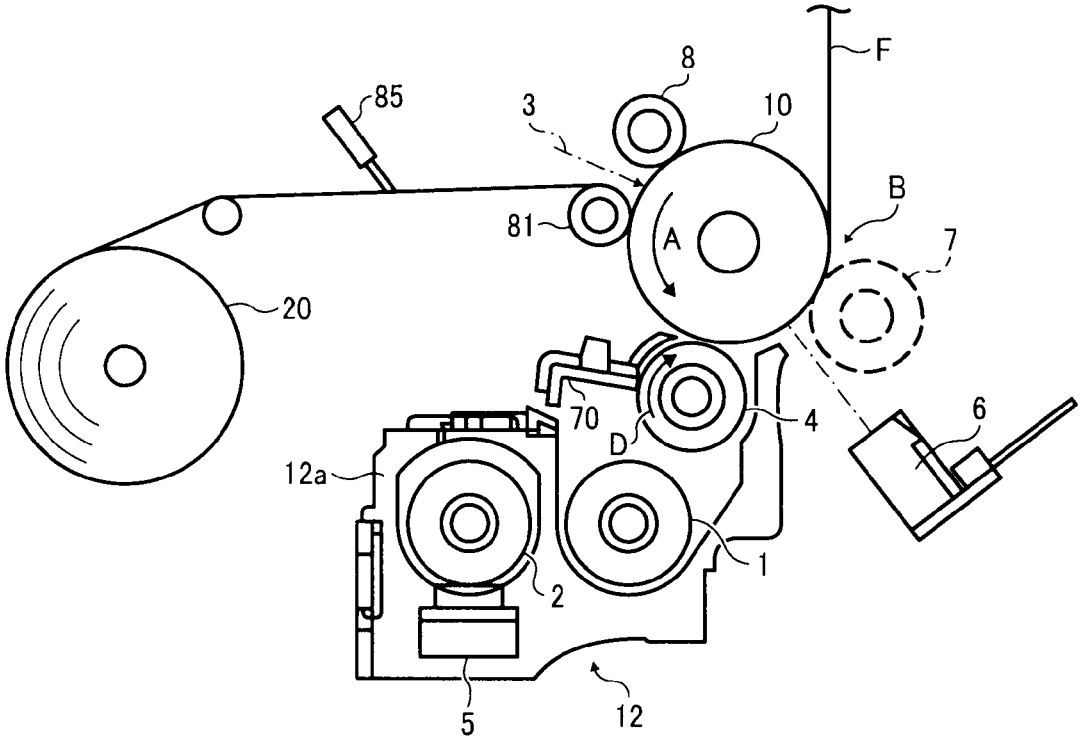

FIG. 22 illustrates the entire of the fifth example (copier) of the image forming apparatus of the present invention, and FIG. 23 illustrates the image forming section thereof including the photoreceptor and neighboring devices.

A copier 503 illustrated in FIG. 20 is the same as the copier 500 illustrated in FIG. 2 except that the configuration of the cover film supplying device 20 is different, the cover film F is contacted with the photoreceptor 10 after the photoreceptor is subjected to the charging and light irradiation processes, and a film charge removing device for reducing charge of the cover film before the cover film reaches the contact point of the cover film with the photoreceptor 10 is provided. Therefore, the different points will be mainly explained.

In the above-mentioned first example illustrated in FIG. 2, the cover film supplying device 20 is arranged on the left side of the charging device 11, and the laser writing device 47 is arranged below the cover film supplying device 20. In contrast, in the fifth example illustrated in FIG. 22, the cover film supplying device 20 is provided on the left side of the developing device 12, and the laser writing device 47 is arranged above the cover film supplying device 20. Although the positions of the devices 20 and 47 are different, devices, which can be used as the devices 20 and 47 of the first example (i.e., copier 500) illustrated in FIG. 2, can also be used for the fifth example (copier 503) illustrated in FIG. 22.

As illustrated in FIG. 23, the copier 503 includes a cover film supplying roller 81 for adhering the cover film to the surface of the photoreceptor 10 whereas the charging roller 8 adheres the cover film to the surface of the photoreceptor in the copier 500 illustrated in FIG. 2. In addition, in the copier 503 the surface of the photoreceptor is covered with the cover film after the photoreceptor is subjected to the charging and light irradiating processes.

Specifically, at first the photoreceptor 10 is rotated by a driving motor (not shown), and the charging roller 8 charges the surface of the photoreceptor (charging process). The light irradiating device 47 irradiates the charged photoreceptor with light according to the image information of the original image read by the image reading device 200 to form an electrostatic latent image on the photoreceptor (light irradiating process). After the electrostatic latent image is formed on the surface of the photoreceptor, the surface is covered with the cover film F supplied from the cover film supplying device 20 via the cover film supplying roller 81. The electrostatic latent image formed on the surface of the photoreceptor is developed by the developer including a toner and contained in the developing device 12 with the cover film therebetween, thereby forming a toner image on the cover film covering the photoreceptor.

Next, the cover film supplying operation will be explained by reference to FIG. 23.

When an image is formed in the fifth example (i.e., copier 503), at first the surface of the photoreceptor 10 is uniformly charged by the charging roller 8 of the charging device 11. Next, the laser writing device 47 irradiates the charged photoreceptor with light to form an electrostatic latent image on the surface of the photoreceptor. The cover film supplying device 20 supplies the cover film F to the surface of the photoreceptor bearing the electrostatic latent image via the cover film supplying roller 81. The cover film is fed to the downstream side relative to the rotation direction of the photoreceptor while adhered to the surface of the photoreceptor by the pressing force of the cover film supplying roller 81. In addition, since the photoreceptor 10 is rotated, the cover film F of the cover film roll set in the cover film supplying device 20 is sequentially fed toward the photoreceptor. In this case, since the cover film F is a thin dielectric material, an electrostatic latent image similar to the electrostatic latent image formed on the photoreceptor is induced on the outer surface of the cover film. Therefore, the induced electrostatic latent image is developed by the developer of the developing device 12, thereby forming a toner image on the cover film F.

After the sheet is overlaid on the cover film with the toner image therebetween, the combination of the cover film and the sheet is fed to the heat fixing device 22, thereby fixing the toner image on the sheet. The combination of the cover film and the sheet with the fixed toner image therebetween is then fed to the discharging roller 35, and then the cover film is cut by the cover film cutting mechanism 90, followed by discharging of a copy (i.e., the sheet S bearing the fixed toner image covered with the cover film) on the stacking section 39.

In such a case where the cover film F is supplied to the surface of the photoreceptor 10 bearing an electrostatic latent image thereon like this fifth example, the electrostatic latent image is damaged if the cover film is charged. Therefore, in this fifth example, a film discharging brush 85 serving as film discharging means is provided on an upstream side from the cover film supplying roller 81. The film charge removing device is not limited to such a brush, and other charge removing devices such as discharging wires can also be used.

The film discharging brush 85 has a length of about 350 mm in the direction perpendicular to the feeding direction of the cover film F, and has a metallic main body holding discharging fibers which are grounded through a wire (not shown). The tip of the fibers is contacted with the surface of the cover film F to remove the charges therefrom. By covering the surface of the photoreceptor bearing an electrostatic latent image with the thus discharged cover film, the same electrostatic latent image as that on the surface of the photoreceptor is induced on the cover film without damaging the electrostatic latent image on the photoreceptor.

The films used as the cover film F in the first example have a dielectric constant of from about 2 to about 3. By using a film having a higher dielectric constant of 4 or more as the cover film F, an electrostatic latent image can be easily induced on the cover film, thereby forming a sharp toner image. Specific examples of such films having a high dielectric constant include cellophane (having a dielectric constant of 7) and fluorine-containing resins (having a dielectric constant of 4 to 8).

Depending on the materials constituting the cover film, the surface of the photoreceptor is frictionally charged when contacted with the cover film, thereby damaging the electrostatic latent image on the surface of the photoreceptor. Therefore, it is preferable that the cover film has an outermost layer which includes a material similar to the material included in the outermost layer of the photoreceptor 10 (i.e., a material having the same unit (e.g., carbonate bonds, ester bonds and carbon-fluorine bonds) as a material included in the outermost layer of the photoreceptor 10). In this case, the cover film F is hardly charged frictionally when contacted with the photoreceptor, and thereby the latent image damaging problem is hardly caused. It is more preferable that the cover film has an outermost layer which includes the same material as the material included in the outermost layer of the photoreceptor 10.

Next, an example of the configuration such that the cover film F has an outermost layer which includes a material similar to the material included in the outermost layer of the photoreceptor 10 will be explained.

The outermost layer of the photoreceptor 10 is typically made of a fluorine-containing resin or a polycarbonate resin. Therefore, it is preferable to form an outermost layer using such a resin on the surface of the cover film. The thickness of the outermost layer is preferably not greater than 30 μm. When the outermost layer is too thick, it is difficult to induce an electrostatic latent image on the surface of the cover film. Specific examples of the method for preparing the outermost layer include spray coating methods which spray a coating liquid prepared by dissolving or dispersing such a resin in a solvent, but are not limited thereto.

In order to prevent occurrence of the latent image damaging problem, it is also preferable to use a film including a material similar to or the same material as the material included in the outermost layer of the photoreceptor 10.

In this fifth example, the cover film F is fixed to the sheet S at the fixing process similar to the first example. However, the cover film is not necessarily fixed to the sheet, and may be separated from the sheet at a position between the transfer position and the fixing position or after the fixing position so that only the sheet S bearing a fixed toner image thereon is discharged as a copy sheet from the copier 503. In this case, the cover film F is not necessarily transparent, and opaque films can be used as the cover film, resulting in enhancement of freedom of choice of materials for the cover film.

As mentioned above by reference to several examples and modified examples, the image forming apparatus of the present invention has the photoreceptor 10, which serves as a latent image bearing member and which rotates; the charging device 11, which serves as charging means and which evenly charges the surface of the photoreceptor; the laser writing device 47, which serves as latent image forming means and which irradiates the charged photoreceptor with imagewise light to form an electrostatic latent image; the developing device 12, which serves as toner image forming means and which supplies a toner to the electrostatic latent image to form a toner image on the photoreceptor; and the transferring device 13, which serves as toner image transferring means and which transfers the toner image onto the sheet S. In addition, the image forming apparatus includes the cover film supplying device 20, which serves as cover film supplying means and which supplies the cover film F to the surface of the photoreceptor 10 at the development position at the latest to cover the surface with the cover film. The cover film is separated from the sheet at a position between the transfer position B and the (next) film supplying position. Alternatively, the cover film is attached to the sheet without separated therefrom, and the combination of the cover film and sheet with the toner image therebetween is discharged from the image forming apparatus as a copy sheet.

By developing an electrostatic latent image on the surface of the photoreceptor 10 with the cover film therebetween, and then separating the cover film from the photoreceptor, the toner does not remain on the surface of the photoreceptor. Therefore, the image forming apparatus does not need a cleaning device for removing residual toner from the photoreceptor.

In the first to fourth examples and the third to sixth modified examples, the cover film supplying device 20 supplies the cover film F to the surface of the photoreceptor 10 before the charging roller 8 charges the photoreceptor. When the image forming apparatus has such a structure, the configuration such that the surface of the photoreceptor is covered with the cover film at the development position at the latest can be established.

In addition, when the cover film F is supplied to the surface of the photoreceptor 10 before the charging roller 8 charges the photoreceptor, abrasion of the photoreceptor due to direct charging performed on the photoreceptor can be prevented. In addition, even when the photoreceptor is unexpectedly charged by the cover film contacted with the photoreceptor, the surface of the photoreceptor can be evenly charged by the following charging operation using the charging roller 8.

Further, in the first to third examples and the third to sixth modified examples, the charging roller 8 serves as stretching means for tightly stretching the cover film. Therefore, the number of parts constituting the image forming apparatus can be reduced.

Furthermore, by using a cover film having a lower hardness than the surface of the photoreceptor, abrasion of the photoreceptor can be minimized, resulting in prolongation of the life of the photoreceptor. Therefore, the photoreceptor can be repeatedly used for a long period of time.

In the first modified example, the cover film is supplied to the surface of the photoreceptor at a position between the charging position and the light irradiation position (i.e., latent image forming position). When the image forming apparatus has such a structure, the configuration such that the surface of the photoreceptor is covered with the cover film at the development position at the latest can be established.

In the fifth example and the second modified example, the cover film is supplied to the surface of the photoreceptor at a position between the light irradiation position (latent image forming position) and the development position. When the image forming apparatus has such a structure, the configuration such that the surface of the photoreceptor is covered with the cover film at the development position at the latest can be established.

In the first and third to fifth examples, and the first modified example, the cover film F is transferred onto the surface of the sheet S together with the toner image at the transfer position B. In addition, in the third modified example, the cover film is separated from the surface of the photoreceptor together with the toner image, and then overlaid on the surface of the sheet S at the nip between the transfer roller 7 and the opposed transfer roller 73. When the image forming apparatus has such a structure, an image covered with the cover film, which has good texture like photographic images, can be produced. In addition, the entire toner image formed on the photoreceptor with the cover film therebetween can be transferred onto the sheet S, i.e., the toner image can be transferred at a transfer rate of 100%. Therefore, occurrence of conventional image problems such that images having omissions or granular images (i.e., uneven density images) are formed due to defective toner image transfer can be prevented.

In the second example and the second modified example, the toner image on the cover film F is transferred onto the sheet Sat the transfer position B, and then the cover film is collected by the cover film collecting device 101. When the image forming apparatus has such a structure, the toner image can be transferred onto the sheet similarly to conventional image forming apparatus.

In the above-mentioned examples and modified examples, a transparent film is used as the cover film. Therefore, the light irradiation process can be performed on the photoreceptor with the cover film therebetween, and in addition, an image covered with the transparent film can be produced.

In the second modified example, an opaque film can be used as the cover film. Therefore, freedom of choice of materials for the cover film can be enhanced.

In the third to fifth examples, the configuration such that the cover film is tightly stretched by the photoreceptor 10 and the opposed transfer roller 73 and the transfer roller 7 serve as toner image transferring means. In addition, after the cover film bearing a toner image thereon is separated from the photoreceptor by the configuration such that the cover film is tightly stretched by the photoreceptor 10 and the opposed transfer roller 73, and then the cover film is contacted with the sheet S to avoid impact of the sheet on the photoreceptor in the transfer process, resulting in prevention of occurrence of the shock jitter problem.

In addition, in the third to fifth examples, the cover film F separating from the photoreceptor 10 is contacted with the sheet S at the nip formed by the transfer roller 7 and the opposed transfer roller 73. Thus, the cover film and sheet are held by the pair of rollers while sandwiched thereby, and therefore occurrence of the problem in that the toner image is transferred onto an improper portion of the sheet due to defective feeding of the sheet and/or the cover film can be prevented.

Further, in the third to fifth examples, a transfer bias voltage having a polarity opposite to that of the charge of the toner is applied to the transfer roller 7 contacting the sheet S, so that the toner image can be well transferred onto the sheet. If such a transfer roller is arranged so as to be close to the photoreceptor 10, it is likely that the photoreceptor is damaged by the transfer bias (which has a polarity opposite to that of charge formed on the photoreceptor), resulting in shortening of the life of the photoreceptor. Since the transfer roller 7 is arranged so as to be apart from the photoreceptor 10 in the third to fifth examples, occurrence of such a photoreceptor damaging problem can be prevented. Therefore, the photoreceptor can maintain a long life.

In the sixth modified example, the sheet S is contacted with the cover film F at the contact position G, and the combination of the sheet and the cover film is separated from the photoreceptor at the separation position H located on the downstream side from the contact position G and transfer position B. Therefore, even when delamination discharging due to separation of the cover film from the photoreceptor is caused, occurrence of the toner scattering problem is prevented and deterioration of image qualities due to toner scattering can be prevented (i.e., a sharp image without background development can be produced).

In addition, in the sixth modified example, the sheet S is contacted with the cover film F at the contact position G, located on the upstream side from the transfer position B at which the transfer roller 7 is contacted with the photoreceptor with the cover film and transfer belt 17 therebetween. Thus, the cover film bearing a toner image thereon can be contacted with the sheet S before the cover film is influenced by the transfer bias applied to the transfer roller. Therefore, occurrence of a problem in that the toner image on the cover film is scattered due to the transfer bias can be prevented, and a sharp image without background development can be produced.

Further, in the sixth modified example, the transfer roller 7 of the transferring device 13 is arranged so as to be contacted with the photoreceptor 10 with the cover film F and sheet S therebetween while a transfer bias voltage having a polarity opposite to that of the charge of the toner is applied to the transfer roller. Therefore, after the cover film and the sheet are electrostatically adhered to each other by the transfer bias, the combination of the cover film and the sheet is separated from the photoreceptor. Therefore, even when delamination discharging due to separation of the cover film from the photoreceptor is caused, occurrence of the toner scattering problem is prevented because the gap between the cover film and the sheet is narrow. Therefore, a sharp image without background development can be produced.

In addition, since the sheet S is fed to the contact position G by the transfer belt 17 in the sixth example, the chance of occurrence of a problem in that the tip of the sheet S flip-flops due to collision of the sheet with the cover film and the photoreceptor can be prevented. It is preferable to arrange a pre-transfer pressing member on an upstream side from the transfer position to enhance adhesion of the sheet to the cover film.

In the seventh modified example, the sheet-form transfer member 77 serving as the transferring device has the fixed end 77*a* on the upstream side from the transfer position at which the transfer member 77 is located so as to be closest to the photoreceptor 10 and the free end 77*b* on the downstream side from the transfer position. In addition, the pressing member 78 of the transferring device 13 presses the sheet-form transfer member 77 to the photoreceptor 10. Since the transfer member 77 is contacted with the photoreceptor 10 with the cover film F and the transfer belt 17 therebetween, the transferring device has a simple structure and therefore costs of the transferring device can be reduced.

In the above-mentioned examples and modified examples, the cover film supplying device 20 has a roll-form cover film F and unwinds the cover film to supply the cover film to the surface of the photoreceptor 10 so that the surface of the photoreceptor is covered with the cover film. Therefore, the cover film F is continuously supplied to the surface of the photoreceptor as the image forming operation proceeds, resulting in realization of automatic supply of the cover film to the surface of the photoreceptor.

In the first, third, fourth and fifth examples and the third and sixth modified examples, the cover film cutting mechanism 90 for cutting the cover film in the direction perpendicular to the feeding direction of the cover film is provided so that the continuous cover film is cut so as to have the desired length. Therefore, an image, which is formed on the sheet S while covered with the cover film F and which has a good combination of evenness and glossiness, can be produced.

In the first, third and fifth examples and the third and sixth modified examples, after the cover film F is transferred from the photoreceptor 10 to the sheet S so that the cover film is overlaid on the sheet S with a toner image therebetween, the rear edge of the cover film is cut by the cover film cutting mechanism 90 so as to be identical to the rear edge of the sheet. Therefore, the cover film is tightly stretched in a range of from the cover film supplying device 20 to the cover film cutting mechanism 90, and thereby the cover film is closely adhered to the surface of the photoreceptor 10 in a range of from the cover film supplying position to the cover film separation position, within which the development position is included. Therefore, a clear image can be formed on the cover film covering the photoreceptor.

In addition, in the first and fifth examples and the third and sixth modified examples, the cover film cutting mechanism 90 cuts the cover film such that the front edge of the cover film is identical to the front edge of the sheet. Therefore, the cover film has the same length as the sheet S in the cover film feeding direction.

In the third example, the controller of the image forming apparatus controls such that after cutting the cover film with the cover film cutting mechanism 90, the pair of feeding rollers 96 arranged on the upstream side from the cutting mechanism, the photoreceptor 10, and the rotation shaft of the cover film supplying device, on which the roll-form cover film is set are rotated in the direction opposite to the rotation direction thereof in the image forming operation so that the tip of the continuous cover film returns the starting position, and the cover film is then fed such that the position of the tip thereof becomes identical to the position of the tip of the next sheet. Therefore, the cover film can be used without producing waste of the cover film.

The third example has the heat fixing device 22 configured to heat the combination of the cover film F and the sheet S with a toner image therebetween, and the cover film cutting mechanism 90 configured to cut the cover film on an upstream side from the fixing device while feeding the cover film in the opposite direction to return the cover film to the starting position. Since the cover film returned to the starting position is not heated by the heat fixing device, the cover film can be used for the next image forming operation similarly to the brand-new cover film.

In the first example illustrated in FIGS. 5 and 6 and the third example, the cover film cutting mechanism 90 is located on the upstream side from the heat fixing device 22 and cuts the cover film such that the rear edge thereof faces the rear edge of the sheet. Therefore, an image, the entire surface of which is covered with the cover film, can be produced.

In the first and fifth examples, the combination of the cover film F and the sheet S with a toner image therebetween is heated by the heat fixing device 22, and the rear edge of the cover film is cut on a downstream side from the fixing device. Thus, the cover film is cut after the toner image is melted and then solidified and the cover film is fixed to the sheet with the fixed toner image therebetween, occurrence of the problem in that the toner image is misaligned due to the impact of the cutting operation can be prevented. Therefore, a clear image can be produced.

In the fourth example, the cover film cutting mechanism 90 cuts the cover film F so as to have the same length as the sheet S on an upstream side from the contact position of the cover film with the surface of the photoreceptor 10. Therefore, the cover film can be saved without producing waste. In addition, since a container for containing waste portions of the cover film is not necessary, the image forming apparatus can be miniaturized.

In the fourth example, the cover film F is supplied to the surface of the photoreceptor on an upstream side from the charging roller 8, and the charging roller serves as a feeding member for feeding the cover film. Therefore, the photoreceptor is hardly damaged by the electric stress caused by the charging operation, and thereby the life of the photoreceptor can be prolonged. In addition, since the charging roller serves as a feeding member, the number of parts of the image forming apparatus can be reduced, resulting in cost reduction and miniaturization of the image forming apparatus.

In the fifth example, the cover film is supplied to the surface of the photoreceptor, on which an electrostatic latent image has been formed, and the film discharging brush 85 for reducing charge of the cover film is provided. Therefore, occurrence of the problem in that the surface potential of the electrostatic latent image of the photoreceptor is influenced by the charge of the cover film can be prevented, resulting in prevention of formation of a defective toner image caused by a damaged electrostatic latent image.

In the fifth example and the second modified example, in which the cover film is supplied to the surface of the photoreceptor bearing an electrostatic latent image thereon, a film having a relatively high dielectric constant of not less than 4 is preferably used for the cover film F. In this case, an electrostatic latent image corresponding to the electrostatic latent image formed on the photoreceptor is easily induced on the surface of the cover film. Therefore, a sharp image can be produced.

It is preferable to form an outermost layer, which includes the same material as the material constituting the outermost layer of the photoreceptor or a material similar to the material constituting the outermost layer of the photoreceptor, on the surface of the cover film to prevent occurrence of friction charging caused by friction between the cover film and the photoreceptor, i.e., to prevent formation of a defective toner image caused by a damaged electrostatic latent image.

It is also preferable to use a cover film including the same material as the material constituting the outermost layer of the photoreceptor or a material similar thereto to prevent occurrence of friction charging caused by friction between the cover film and the photoreceptor, i.e., to prevent formation of a defective toner image caused by a damaged electrostatic latent image.

This document claims priority and contains subject matter related to Japanese Patent Application No. 2009-111208, filed on Apr. 30, 2009, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a latent image bearing member having a moving surface;

a charging device configured to charge the surface of the latent image bearing member at a charging position;

a latent image forming device configured to form an electrostatic latent image on the surface of the latent image bearing member at a latent image forming position;

a developing device configured to supply toner to the electrostatic latent image at a development position to form a toner image on a surface of a cover film covering the surface of the latent image bearing member;

a cover film supplying device configured to supply the cover film to the surface of the latent image bearing member at a cover film supplying position located on an upstream side from the development position relative to a moving direction of the latent image bearing member so that the surface of the latent image bearing member is covered with the cover film and the toner image is formed on the surface of the cover film covering the latent image bearing member; and a cover film separating device configured to separate the cover film bearing the toner image thereon from the surface of the image bearing member before the cover film bearing the toner image thereon reaches the cover film supplying position, wherein the cover film supplying position is the same as the charging position or is located on an upstream side from the charging position relative to the moving direction of the latent image bearing member.

2. The image forming apparatus according to claim 1, wherein a surface of the cover film contacting the latent image bearing member has a surface Rockwell hardness lower than a surface Rockwell hardness of the surface of the latent image bearing member.

3. The image forming apparatus according to claim 1, further comprising:

a toner image transferring device configured to transfer the cover film bearing the toner image thereon onto a receiving medium at a transfer position, wherein the toner image transferring device serves as the cover film separating device.

4. The image forming apparatus according to claim 1, wherein the cover film is a continuous cover film sheet, and the cover film supplying device supplies a part of the continuous cover film sheet to the surface of the latent image bearing member to cover the surface of the latent image bearing member with the part of the continuous cover film sheet, and wherein the image forming apparatus further comprises:

a cover film cutting mechanism configured to cut the continuous cover film sheet in a direction perpendicular to a feeding direction of the continuous cover film sheet.

5. The image forming apparatus according to claim 1, further comprising:

a toner image transferring device configured to transfer the toner image formed on the cover film covering the latent image bearing member onto a receiving material or a toner image bearing member at a transfer position.

6. The image forming apparatus according to claim 1, further comprising:

a toner image transferring device configured to transfer the toner image formed on the cover film covering the latent image bearing member onto a receiving material or a toner image bearing member at a transfer position, wherein the cover film bearing the toner image thereon is contacted with the receiving material or a toner image bearing member after separated from the latent image bearing member by the cover film separating device.

7. The image forming apparatus according to claim 1, wherein the cover film is transparent.

8. The image forming apparatus according to claim 1, wherein the cover film has a roll form in the cover film supplying device, and the cover film supplying device unwinds the roll-form cover film to supply the cover film to the surface of the latent image bearing member.

9. The image forming apparatus according to claim 1, further comprising:

a cover film charge removing device configured to reduce charge of the cover film before the cover film is contacted with the surface of the latent image bearing member.

10. The image forming apparatus according to claim 1, wherein the cover film has a dielectric constant of not less than 4.

11. The image forming apparatus according to claim 1, wherein the cover film has an outermost layer to be contacted with the surface of the latent image bearing member, wherein the outermost layer includes a material having a surface structure similar to a structure included in a material included in an outermost layer of the latent image bearing member.

12. The image forming apparatus according to claim 1, wherein the cover film includes a material having a surface structure similar to a structure included in a material included in an outermost layer of the latent image bearing member.

13. An image forming method comprising:

charging a moving surface of a latent image bearing member;

forming an electrostatic latent image on the moving surface of the latent image bearing member;

developing the electrostatic latent image by supplying toner thereto to form a toner image on a surface of a cover film covering the surface of the latent image bearing member at a developing position;

supplying the cover film to the surface of the latent image bearing member at a cover film supplying position located on an upstream side from the development position relative to a moving direction of the latent image bearing member so that the surface of the latent image bearing member is covered with the cover film and the toner image is formed on the cover film covering the surface of the latent image bearing member; and separating the cover film bearing the toner image thereon from the surface of the latent image bearing member before the cover film bearing the toner image thereon reaches the cover film supplying position, wherein the cover film supplying position is the same as the charging position or is located on an upstream side from the charging position relative to the moving direction of the latent image bearing member.

14. An image forming apparatus comprising:

a latent image bearing member having a moving surface;

a charging device configured to charge the surface of the latent image bearing member at a charging position;

a latent image forming device configured to form an electrostatic latent image on the surface of the latent image bearing member at a latent image forming position;

a developing device configured to supply toner to the electrostatic latent image at a development position to form a toner image on a surface of a cover film covering the surface of the latent image bearing member;

a first cover film supplying device configured to supply the cover film to a second cover film supplying device at a first cover film supplying position;

a second cover film supplying device configured to supply the cover film to the surface of the latent image bearing member at a second cover film supplying location located on an upstream side from the development position relative to a moving direction of the latent image bearing member so that the surface of the latent image bearing member is covered with the cover film and the toner image is formed on the surface of the cover film covering the latent image bearing member; and a cover film separating device configured to separate the cover film bearing the toner image thereon from the surface of the image bearing member before the cover film bearing the toner image thereon reaches the cover film supplying position, wherein the second cover film supplying position is located on a downstream side from the charging position.

15. The image-forming apparatus according to claim 2 where a Rockwell hardness of about 60 is used for the cover film, and a polycarbonate resin having a Rockwell hardness of about 80 is used for the surface of the latent image bearing member.

16. The image forming apparatus according to claim 14, wherein the second cover film supplying position is located on an upstream side from the latent image forming position relative to the moving direction of the latent image bearing member.

17. The image forming apparatus according to claim 14, wherein the second cover film supplying position is located on a downstream side from the latent image forming position and an upstream side from the development position relative to the moving direction of the latent image bearing member.

* * * * *